US008652722B2

(12) United States Patent
Yoshida et al.

(10) Patent No.: US 8,652,722 B2
(45) Date of Patent: Feb. 18, 2014

(54) ELECTROSTATIC CHARGE IMAGE DEVELOPING TONER, ELECTROSTATIC CHARGING IMAGE DEVELOPER, TONER CARTRIDGE, PROCESS CARTRIDGE, METHOD OF PRODUCING ELECTROSTATIC CHARGE IMAGE DEVELOPING TONER, AND IMAGE FORMING APPARATUS

(75) Inventors: Satoshi Yoshida, Kanagawa (JP); Tsuyoshi Murakami, Kanagawa (JP); Eisuke Iwazaki, Kanagawa (JP); Shinya Sakamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 79 days.

(21) Appl. No.: 13/397,175

(22) Filed: Feb. 15, 2012

(65) Prior Publication Data

US 2013/0078565 A1 Mar. 28, 2013

(30) Foreign Application Priority Data

Sep. 26, 2011 (JP) ..... 2011-209121

(51) Int. Cl.
*G03G 9/00* (2006.01)

(52) U.S. Cl.
USPC ..... 430/108.24; 430/108.1; 430/109.1; 430/123.5

(58) Field of Classification Search
USPC ..... 430/108.1, 108.24, 109.1, 123.5
See application file for complete search history.

(56) References Cited

U.S. PATENT DOCUMENTS

| | | | | |
|---|---|---|---|---|
| 2006/0222990 | A1 | 10/2006 | Farrugia et al. | |
| 2008/0071130 | A1 * | 3/2008 | Tamura et al. | 588/315 |
| 2010/0092886 | A1 | 4/2010 | Vanbesien et al. | |
| 2010/0248118 | A1 * | 9/2010 | Gong et al. | 430/108.2 |

FOREIGN PATENT DOCUMENTS

| | | |
|---|---|---|
| JP | A-2006-285251 | 10/2006 |
| JP | A-2008-102432 | 5/2008 |
| JP | A-2008-107769 | 5/2008 |
| JP | A-2008-129410 | 6/2008 |
| JP | A-2010-66709 | 3/2010 |
| JP | A-2010-066709 | 3/2010 |
| JP | A-2010-92055 | 4/2010 |

OTHER PUBLICATIONS

Aug. 20, 2013 Office Action issued in Japanese Application No. 2011-209121 (with English translation).

* cited by examiner

*Primary Examiner* — Thorl Chea
(74) *Attorney, Agent, or Firm* — Oliff PLC

(57) ABSTRACT

An electrostatic charge image developing toner contains a binder resin, a release agent, a black colorant, a methylglycine diacetate, and an aluminum element, the content of the methylglycine diacetate is in the range of from 5 ppm to 500 ppm, and the content of the aluminum element is in the range of from 0.07 atomic % to 0.18 atomic % in total element analysis using fluorescent X-rays.

11 Claims, 1 Drawing Sheet

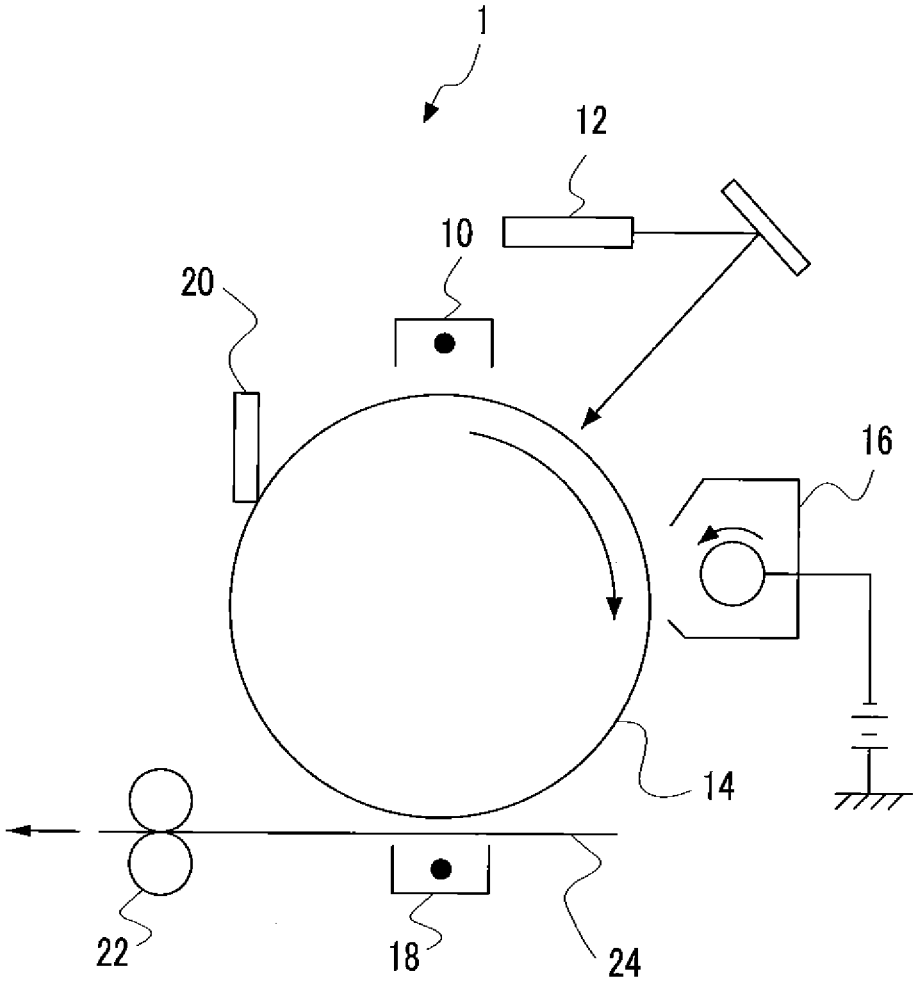
1
12
10
20
16
14
22
18
24

ELECTROSTATIC CHARGE IMAGE DEVELOPING TONER, ELECTROSTATIC CHARGING IMAGE DEVELOPER, TONER CARTRIDGE, PROCESS CARTRIDGE, METHOD OF PRODUCING ELECTROSTATIC CHARGE IMAGE DEVELOPING TONER, AND IMAGE FORMING APPARATUS

CROSS-REFERENCE TO RELATED APPLICATIONS

This application is based on and claims priority under 35 USC 119 from Japanese Patent Application No. 2011-209121 filed Sep. 26, 2011.

BACKGROUND

1. Technical Field

The present invention relates to an electrostatic charge image developing toner, an electrostatic charge image developer, a toner cartridge, a process cartridge, a method of producing an electrostatic charge image developing toner, and an image forming apparatus.

2. Related Art

Methods of visualizing image information via an electrostatic charge image, such as electrophotography, are used in various fields. In the electrophotography, an electrostatic charge image is formed on a photoreceptor through charging and exposing processes, the electrostatic charge image is developed with a developer including an electrostatic charge image developing toner (hereinafter, also simply referred to as "toner"), and the electrostatic charge image is visualized through transfer and fixing processes.

An example of the method of producing the toner is an emulsion aggregating method which is a wet production method, in which toner particles are produced from a mixture dispersion in which a binder resin, a colorant, and the like are dispersed through an aggregation process and the like. The toner produced through the use of the wet production method is smooth in toner shape and is superior in developability and transferability.

The wet production method toner is roughly classified into a production method using a styrene-acryl copolymer resin and a production method using a polyester resin. The styrene-acryl copolymer resin is mainly used for a monochromatic toner requiring a high molecular weight to lower an image surface gloss, because it can be easily polymerized. The polyester resin is mainly used for a color toner, because it can raise the image surface gloss due to the sharp melting property of the resin itself.

Recently, it has been considered that the polyester resin having a high sharp melting property should be used in a monochromatic printer in response to requirement for saving energy. However, since the polyester resin lowers the image surface gloss, there is a problem in that the increase in molecular weight of the resin markedly deteriorates the solubility in an organic solvent and it is thus difficult to produce the toner through the use of the wet production method.

When the polyester resin is crosslinked with the metallic ions, a chelating agent is added thereto to control the toner particle size or the degree of crosslinking.

SUMMARY

According to an aspect of the invention, there is provided an electrostatic charge image developing toner containing: a binder resin; a release agent; a black colorant; a methylglycine diacetate; and an aluminum element, wherein the content of the methylglycine diacetate is in the range of from 5 ppm to 500 ppm, and the content of the aluminum element is in the range of from 0.07 atomic % to 0.18 atomic % in total element analysis using fluorescent X-rays.

BRIEF DESCRIPTION OF THE DRAWING

Exemplary embodiment of the present invention will be described in detail based on the following figures, wherein:

FIG. 1 is a schematic diagram illustrating an example of an image forming apparatus according to an exemplary embodiment of the invention.

DETAILED DESCRIPTION

Hereinafter, a mode for putting the invention into practice (hereinafter, referred to as an exemplary embodiment) will be described.

Electrostatic Latent Image Developing Toner

An electrostatic charge image developing toner (hereinafter, also simply referred to as a "toner") according to this exemplary embodiment contains a binder resin, a release agent, a black colorant, a methylglycine diacetate, and an aluminum element, wherein the content of the methylglycine diacetate is in the range of from 5 ppm to 500 ppm, and the content of the aluminum element is in the range of from 0.07 atomic % to 0.18 atomic % in total element analysis using fluorescent X-rays.

Here, the binder resin contains at least an amorphous polyester resin to be described later and may contain a crystalline polyester resin. The binder resin preferably is a resin obtained by polymerizing a monomer having an alkyl side chain.

In general, since a polyester toner produced through the use of a wet production method such as an emulsion aggregating method has a high hydrophilic property, the polyester toner easily adsorbs ions in water, particularly, sodium ions which are strongly alkaline, and is easily plasticized (softened). The adsorption site includes a hydrophilic part of a polyester resin, an ester-bonded part, a carboxylic acid, and a sulfonic acid. Particularly, in the polyester having both a sulfonic acid and a carboxylic acid, sodium easily remain in several acids due to a difference in dissociation constant between the sulfonic acid and the carboxylic acid. In this way, since the polyester toner produced through the use of the wet production method according to the related art is easily plasticized, the gloss increases in a part having a high fixing pressure. Therefore, as described above, when the binder resin is a polyester resin having a monomer with an alkyl side chain as a polymerization unit, the alkyl side chain shields the ester part, thereby suppressing adsorbing and coupling of sodium and suppressing plasticization of the toner.

The electrostatic charge image developing toner according to this exemplary embodiment preferably contains ammonia in the range of from 0.05 mg/l to 0.6 mg/l in terms of $NH_4^+$ ions (ammonium ions) in ion chromatography analysis. By containing the $NH_4^+$ ions, it is possible to form a carboxylate-ammonia interaction in advance and to suppress formation of a carboxylate-sodium interaction in the toner producing process. As a result, it is possible to suppress plasticization (softening) of the toner due to the sodium ions and to suppress an excessive increase in gloss of a formed image. Here, when the content of ammonia is less than 0.05 mg/l in terms of $NH_4^+$ ions, the plasticization of the toner proceeds and thus the unevenness in gloss of an image is deteriorated. When the content of ammonia is greater than 0.6 mg/l, the amount of charged electricity is lowered due to the hygroscopicity of the ions.

The components of the toner will be described below in detail.

Binder Resin

The binder resin according to this exemplary embodiment contains at least an amorphous polyester resin and may contain a crystalline polyester resin. The amorphous polyester resin and the crystalline polyester resin will be described below in detail. For the purpose of convenient explanation, the crystalline polyester resin and the amorphous polyester resin will be described in this order.

—Crystalline Polyester Resin—

A polymerizable monomer having a straight-chain aliphatic component rather than a polymerizable monomer having an aromatic component can be preferably used as a polymerizable monomer component of the crystalline polyester resin so as to easily form a crystal structure. In order not to decrease the crystallinity, the respective components originating from the polymerizable monomer are preferably equal to or more than 30 mol % as a single species in the polymer. The crystalline polyester resin necessarily includes two or more species of polymerizable monomers as the constituents, and the content of each necessary polymerizable monomer species is preferably the above-mentioned (equal to or more than 30 mol %).

The melting temperature of the crystalline polyester resin is preferably in the range of from 50° C. to 100° C., more preferably in the range of from 55° C. to 90° C. (or from about 55° C. to about 90° C.), and still more preferably in the range of from 60° C. to 85° C. When the melting temperature is lower than 50° C., the deterioration in toner conservation such as blocking in the conserved toner or the deterioration in fixed image conservation after the fixation (problems such as a so-called document offset in which a fixed image is attached is attached to a background part or a rear surface of a sheet of paper or image parts are attached to each other or a vinyl offset in which an image is transferred to a vinyl chloride sheet) may occur. When the melting temperature is higher than 100° C., satisfactory low-temperature fixability may not be achieved.

The melting temperature of the crystalline polyester resin can be calculated as a peak temperature of an endothermic peak acquired through the use of differential scanning calorimetry (DSC).

In this exemplary embodiment, the "crystalline polyester resin" means that it does not have a step-like variation in absorbed heat but have clear endothermic peaks in the differential scanning calorimetry (DSC). The "crystalline polyester resin" means a polymer (copolymer) formed by polymerizing the components of polyester and other components as well as a polymer having a 100% polyester structure. Here, in the latter, the other components other than polyester of the polymer (copolymer) are equal to or less than 50% by mass.

The crystalline polyester resin is synthesized, for example, from a polyvalent carboxylic acid component and a polyol component. In this exemplary embodiment, commercially-available products may be used as the crystalline polyester resin or synthesized products thereof may be used.

Examples of the polyvalent carboxylic acid component include aliphatic dicarboxylic acids such as oxalic acid, succinic acid (dodecenyl succinic acid and the like), glutaric acid, adipic acid, suberic acid, azelaic acid, sebacic acid, 1,9-nonane dicarboxylic acid, 1,10-decane dicarboxilic acid (dodecane dioic acid), 1,12-dodecane dicarboxilic acid, 1,14-tetradecane dicarboxilic acid, and 1,18-octadecane dicarboxylic acid, aromatic dicarboxylic acids such as phthalic acid, isophthalic acid, terephthalic acid, naphthalene-2,6-dicarboxylic acid, malonic acid, and dibasic acid such as mesaconic acid, anhydrides thereof, and lower alkyl esters thereof, but the polyvalent carboxylic acid is not limited to these examples.

Examples of a trivalent or higher-valent carboxylic component include 1,2,4-benzene tricarboxylic acid, 1,2,5-benzene tricarboxylic acid, 1,2,4-naphtalene tricarboxylic acid, anhydrides thereof, and lower alkyl esters thereof. These may be used singly or in combination of two or more.

Aliphatic diol can be preferably used as the polyvalent alcohol component and straight-chain aliphatic diol with a carbon number of a main-chain part of 2 to 20 can be more preferably used. In a branched type of aliphatic diol, the crystallization of the polyester resin is lowered and the melting temperature may be lowered. When the carbon number of the main-chain part is greater than 20, it is difficult to obtain the material in practice. It is preferable that the carbon number of the main-chain part is equal to or less than 14.

Specific examples of the aliphatic diol used very suitably for the synthesis of the crystalline polyester resin include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol, but the aliphatic diol is not limited to these examples. Among these, 1,6-hexanediol, 1,8-octanediol, 1,9-nonanediol, and 1,10-decanediol can be preferably used in consideration of availability.

A trihydric or higher-hydric alcohol component can be used as a polyol component and examples thereof include glycerin, trimethylol ethane, trimethylol propane, and pentaerythritol. These may be used singly or in combination of two or more.

In the polyol component, the content of the aliphatic diol is preferably equal to or more than 80 mol % and more preferably equal to or more than 90 mol %. When the content of the aliphatic diol is less than 80 mol %, the crystallization of the polyester resin is lowered and the melting temperature is lowered, thereby deteriorating toner blocking resistance, image conservation, and low-temperature fixability.

For the purpose of adjustment of an acid value or a hydroxyl value, the polyvalent carboxylic acid or the polyol may be added in the final stage of synthesis if necessary. Examples of the polyvalent carboxylic acid include aromatic carboxylic acids such as terephthalic acid, isophthalic acid, phthalic anhydride, trimellitic anhydride, pyromellitic acid, and naphthalene dicarboxylic acid, aliphatic carboxylic acids such as maleic anhydride, fumaric acid, succinic acid, alkenyl succinic anhydride, and adipic acid, and alicyclic carboxylic acids such as cyclohexane dicarboxylic acid.

The production of the crystalline polyester resin is performed at a polymerization temperature of from 170° C. to 230° C., a reaction system is depressurized if necessary, and the reaction is made to proceed while removing water or alcohol produced in condensation.

When the polymerizable monomer is insoluble or immiscible at a reaction temperature, a high-boiling-point solvent may be added as a solubilizing agent to dissolve the polymerizable monomer. The polycondensation reaction is performed while distilling the solubilizing agent. When a polymerizable monomer poor compatibility is present in the copolymerization reaction, the polymerizable monomer having poor compatibility can be condensated with the acid or alcohol to be polycondensed with the polymerizable monomer in advance and then the condensed product can be polycondensed with the main component.

Examples of a catalyst used to produce the polyester resin include alkali metal compounds of sodium, lithium, and the like, alkali earth metal compounds of magnesium, calcium, and the like, metal compounds of zinc, manganese, antimony, titanium, tin, zirconium, germanium, and the like, phosphite compounds, phosphate compounds, and amine compounds.

The acid value (the mg value of KOH necessary for neutralizing 1 g of a resin) of the crystalline polyester resin is preferably in the range of from 3.0 mgKOH/g to 30.0 mgKOH/g, more preferably in the range of from 6.0 mgKOH/g to 25.0 mgKOH/g, and still more preferably in the range of from 8.0 mgKOH/g to 20.0 mgKOH/g.

When the acid value is smaller than 3.0 mgKOH/g, the dispersibility in water is lowered and it is thus difficult to produce emulsified particles through the use of a wet production method. Since the stability of the emulsified particles in aggregation is markedly lowered, it may be difficult to efficiently produce a toner. On the other hand, when the acid value is greater than 30.0 mgKOH/g, the hygroscopicity of the toner increases and the toner may easily accept an influence from the normal environment.

The weight-average molecular weight (Mw) of the crystalline polyester resin is preferably in the range of from 6000 to 35000. When the weight-average molecular weight (Mw) is less than 6000, the toner may deeply bleed the surface of a recording medium such as a sheet of paper during fixing to cause fixing unevenness or to lower bending resistance of a fixed image. When the weight-average molecular weight (Mw) is greater than 35000, viscosity during dissolving may be excessively raised and thus a temperature for reaching the viscosity appropriate for the fixing may be raised, thereby preventing the low-temperature fixability. The method of measuring the weight-average molecular weight will be described later.

—Amorphous Polyester Resin—

Examples of the amorphous polyester resin preferably used in this exemplary embodiment include products acquired through polycondensation reactions of polyvalent carboxylic acids and polyols.

Here, various dicarboxylic acids mentioned for the crystalline polyester resin can be used as the polyvalent carboxylic acid used for synthesis of the amorphous polyester resin. Various dials used for synthesis of the crystalline polyester resin can be used as the polyol, and bisphenol A, bisphenol A ethylene oxide adducts, bisphenol A propylene oxide adducts, hydrogen-added bisphenol A, bisphenol S, bisphenol S ethylene oxide adducts, and bisphenol S propylene oxide adducts can be used in addition to the aliphatic dials mentioned for the crystalline polyester resin. In order to improve productivity, heat resistance, and transparency of the toner, bisphenol A, bisphenol A ethylene oxide adducts, bisphenol A propylene oxide adducts, and hydrogen-added bisphenol A can be preferably used. Various components may be included along with the polyvalent carboxylic acid and the polyol. Particularly, since bisphenol A is incompatible with an alkyl-based release agent, the position of the release agent in the toner particles can be easily controlled and the offset (a phenomenon that a part of a toner image is attached to a fixing roll and is removed) can be easily suppressed by controlling bleeding of the release agent. A dimer diol may be used in addition to the above-mentioned diols.

The dimer diol is an aliphatic diol with a carbon number of about 36 which may be obtained by perfectly hydrogenating a dimer acid and may be obtained as a mixture of a geometrical isomer of a dimer diol having a branched structure or a cyclohexane ring. The dimer acid is formed by thermally polymerizing a carboxylic acid with a carbon number of about 18 such as unsaturated fatty acids such as linoleic acid, oleic acid, and linolenic acid and a drying oil fatty acid or a semi-drying oil fatty acid obtained from tall oil, cottonseed oil, and soybean oil and then distilling and refining the product. The main component thereof is a dicarboxylic acid with a carbon number of 36.

Regarding the molecular weight of the amorphous polyester resin, the weight-average molecular weight (Mw) is preferably in the range of from 15000 to 140000 and the number-average molecular weight Mn is preferably in the range of from 4000 to 12000. Here, when one species of amorphous polyester resin or a combination of two or more species thereof in the above-mentioned range is used as the toner, the weight-average molecular weight (Mw) is preferably in the range of from 25000 to 80000. When the weight-average molecular weight is in the above-mentioned range, it is easy to cause the lower-temperature fixability, the image conservation, and the fixing gloss to be compatible with each other.

The glass transition temperature (Tg) of the amorphous polyester resin is preferably in the range of from 50° C. to 80° C. When Tg is lower than 50° C., the conservation of the toner or the conservation of the fixed image may be deteriorated. When Tg is higher than 80° C., an image may not be fixed at a lower temperature than in the related art. Tg of the amorphous polyester resin is more preferably in the range of from 50° C. to 65° C.

The production of the amorphous polyester resin is performed similarly to the crystalline polyester resin.

The binder resin is preferably soluble in tetrahydrofuran. Here, "soluble in tetrahydrofuran" means that when 1 g of the binder resin is added to 10 ml of tetrahydrofuran and the solution is dispersed at 25° C. for 5 minutes by the use of an ultrasonic disperser, the binder resin is dissolved in the tetrahydrofuran.

Crosslinking Agent and Chelating Agent

The toner includes aluminum as an aggregating agent and a crosslinking agent and methylglycine diacetate as a chelating agent. The metal such as aluminum added as an aggregating agent may ion-crosslink polyester molecules and quasi-raise the molecular weight thereof. Therefore, it is possible to control the gloss of an image formed on a recording medium such as a sheet of paper by adding aluminum or the like. The content of aluminum in the toner is in the range of from 0.07 atomic % to 0.18 atomic % in total element analysis of the toner using fluorescent X-rays. When the content of aluminum is excessively small, the elastic modulus of the toner is lowered and thus the gloss unevenness of an image is deteriorated. When the content of aluminum is excessively great, the elastic modulus is raised and thus the fixing temperature is raised.

The methylglycine diacetate is added to control the content of aluminum in the toner. In general, the chelating agent has a function of chelating metallic ions and discharged the chelate in an aqueous phase. The methylglycine diacetate serves as the chelating agent and discharges apart of aluminum added during production of a toner in an aqueous phase to control the content of aluminum remaining in the toner. As a result, it is possible to adjust the degree of crosslinking of polyesters as a binder resin and to control the gloss of an image. The content of the methylglycine diacetate is in the range of from 5 ppm to 500 ppm.

Methylglycine diacetate has a weak chelating force with respect to aluminum and aluminum is chelated with two or three molecules of methylglycine diacetate. Accordingly, when it is intended to chelate aluminum, methylglycine diacetate of a certain concentration or higher is necessary, aluminum is not locally chelated in the toner, and thus aluminum can be made to uniformly remain in the toner as a whole. This is because the methylglycine diacetate is, substantially uniformly dispersed in a reaction vessel during addition thereof in the toner producing process and then performs a chelating function and only the part introduced at the first time does not perform the chelating function in the reaction vessel. As a result, the degree of crosslinking of polyester can be easily substantially uniformly adjusted and the elastic modulus of the toner at a high temperature can be raised, thereby reducing the gloss.

As described above, since the methylglycine diacetate has a weak chelating force with respect to aluminum and two or three molecules of the methylglycine diacetate chelate aluminum, the methylglycine diacetate exists in a state where it is adsorbed to aluminum in the state where the concentration of the methylglycine diacetate is low. As a result, since the carboxylate-aluminum interaction is blocked from an attack of sodium and the carboxylate-aluminum interaction is appropriately suppressed, the elastic modulus of the toner is not raised excessively, thereby suppressing a decrease in fixability.

It is also considered that the ion crosslinking force between the polyester resin and aluminum is suppressed to a force suitable for the fixation by including the methylglycine diacetate having such a function in the toner in the range of from 5 ppm to 500 ppm. When the content of the methylglycine diacetate is excessively small, the ion crosslinking force is excessively strong and the elastic modulus of the toner is raised, thereby raising the fixing temperature. When the content of the methylglycine diacetate is excessively great, the ion crosslinking force is lowered, thereby deteriorating the unevenness in gloss of an image.

In the toner, tan δ when the viscosity of the toner is 10000 Pa.s is preferably in the range of from 0.5 to 1.1 (or from about 0.5 to about 1.1). When tan δ is in this range, it is possible to suppress the unevenness in gloss by the effect of elasticity of the toner. When the value of tan δ is excessively low, the elasticity of the toner is strengthened and thus the fixing temperature is raised. On the other hand, when the value of tan δ is excessively high, it is difficult to suppress the unevenness in gloss.

Colorant

The toner may include a colorant if necessary. A dye or a pigment may be used as the colorant without any restriction, but the pigment can be preferably used from the viewpoint of light resistance or water resistance.

In this exemplary embodiment, examples of the pigment used as the colorant are as follows. Examples of a black pigment include carbon black, copper oxide, manganese dioxide, aniline black, activated carbon, nonmagnetic ferrite, and magnetite. In this exemplary embodiment, a toner capable of raising the image density by increasing an amount of carbon black to be added is realized.

In this exemplary embodiment, a black toner having the black pigment (particularly, carbon black) added thereto will be mainly described, but examples of a yellow pigment include chrome yellow, zinc yellow, yellow iron oxide, cadmium yellow, Hansa yellow, Hansa yellow 10G, benzidine yellow G, benzidine yellow GR, threne yellow, quinoline yellow, and permanent yellow NCG. Specific examples thereof include C.I. pigment yellow 74, C.I. pigment yellow 180, and C.I. pigment 93. Among these, C.I. pigment yellow 74 can be preferably used in view of pigment dispersibility. The yellow pigments can be used singly or in combination of two or more.

Examples of an orange pigment include read chrome yellow, molybdenum orange, permanent orange GTR, pyrazolone orange, vulcan orange, benzidine orange GG, indanthrene brilliant orange RK, and indanthrene brilliant orange GK.

Examples of a red pigment include Bengala, cardmium red, red lead, mercury sulfide, watching red, permanent red 4R, lithol red, brilliant carmine 3B, brilliant carmine 6B, DuPont oil red, pyrazolone red, rhodamine B lake, lake red C, rose Bengal, eosin red, and alizalin lake.

Examples of a blue pigment include navy blue, cobalt blue, alkali blue lake, Victoria blue lake, first sky blue, indanthrene blue BC, aniline blue, ultramarine blue, calco oil blue, methylene blue chloride, phthalocyanine blue, phthalocyanine green, and malachite green oxalate.

Examples of a violet pigment include manganese violet, first violet B, and methyl violet lake.

Examples of a green pigment include chromium oxide, chrome green, pigment green, malachite green lake, and final yellow green G.

Examples of a white pigment include zinc white, titanium oxide, antimony white, and zinc sulfide.

Examples of an extender pigment include baryte powder, barium carbonate, clay, silica, white carbon, talc, and alumina white.

A dye may be used as a colorant if necessary. Various dyes such as alkali dyes, acidic dyes, dispersed dyes, and direct dyes may be used as the dye and examples thereof include nigrosin, methylene blue, rose Bengal, quinoline yellow, and ultramarine blue. These may be used singly or in combination, or may be used in a solid solution state.

The colorant is dispersed through the use of known methods and media dispersers such as a rotary shearing homogenizer, a ball mill, a sand mill, and an attritor and a high-pressure collision type disperser can be preferably used.

The colorant may be dispersed in an aqueous medium using a polar surfactant by the use of the homogenizer.

The colorant is selected in view of hue angle, color saturation, brightness, weather resistance, dispersibility in the toner, and the like. The amount of colorant added is preferably in the range of from 1 part by mass to 20 parts by mass with respect to 100 parts by mass of a resin.

Release Agent

The toner may include a release agent if necessary. Examples thereof include low-molecular-weight polyolefins such as polyethylene, polypropylene, and polybutene, silicones having a softening point, fatty acid amides such as oleamide, erucamide, ricinoleic acid amide, and stearic acid amide, plant waxes such as carnauba wax, rice wax, candelilla wax, Japanese wax, and jojoba oil, animal waxes such as bees wax, minerals and petroleum waxes such as montan wax, ozokerite, ceresin, paraffin wax, micro-crystalline wax, and Fischer-Tropsch wax, ester waxes of a higher fatty acid and a higher alcohol such as stearyl stearate and behenyl behenate, ester waxes of a higher fatty acid and a monohydric or polyhydric lower alcohol such as butyl stearate, propyl oleate, glyceride monostearate, glyceride distearate, and pentaerythritol tetrabehenate, ester waxes including a polymer of a higher fatty acid and a polyol such as diethylene glycol monostearate, dipropylene glycol distearate, diglyceride distearate, and triglyceride tetrastearate, sorbitan higher fatty acid ester waxes such as sorbitan monostearate, and cholesterol higher fatty acid ester waxes such as cholesteryl stearate. These release agents may be used singly or in combination of two or more.

The melting temperature of the release agent is preferably in the range of from 50° C. to 100° C. and more preferably in the range of from 60° C. to 95° C.

The content of the release agent in the toner is preferably in the range of from 0.5% by mass to 15% by mass and more preferably in the range of from 1.0% by mass to 12% by mass. When the content of the release agent is less than 0.5% by mass, release failure may occur particularly in oilless fixing. When the content of the release agent is more than 15% by mass, the toner fluidity may be deteriorated, thereby degrading image quality and reliability in formation of an image.

Other Additives

The toner may further include various components such as an internal additive, a charge-controlling agent, an inorganic powder (inorganic particles), and organic particles if necessary, in addition to the above-mentioned components.

The inorganic particles or the organic particles are preferably added to the surfaces of the toner particles while applying a shearing force thereto.

Examples of the internal additive include magnetic materials such as metals such as ferrite, magnetite, reduced iron, cobalt, manganese, and nickel, alloys thereof, and compounds including the metals and are used by an amount by which the chargeability as a toner characteristic is not hindered.

The charge-controlling agent is not particularly limited, but is preferably colorless or light-colored when it is used in a color toner. Examples thereof include quarternary ammonium salt compounds, nigrosin compounds, dyes including complexes of aluminum, iron, and chromium, and triphenylmethane pigments. Particularly, in view of control of ion strength affecting stability during aggregation or coalescence to be described later and reduction of water contamination, materials insoluble in water may be preferably used.

The inorganic particles are added for various purposes and may be added to adjust the viscoelasticity of the toner. The image gloss or the permeation of paper is adjusted by this adjustment of viscoelasticity. As the inorganic particles, known inorganic particles such as silica particles, titania particles, alumina particles, cerium oxide particles, and particles of which the surface is hydrophobized may be used singly or in combination of two or more. From the viewpoint of not damaging a coloring property or transparency such as permeability of an OHP (projection apparatus) sheet, silica particles having a refractive index smaller than that of the binder resin are preferably used. The silica particles may be subjected to a variety of surface treatment and silica particles subjected to surface treatment with a silane coupling agent, a titanium coupling agent, a silicone oil, or the like are preferably used.

The inorganic particles or the organic particles are an external additive externally added to the toner surfaces and specific examples thereof include the followings.

Examples of the inorganic particles include silica, alumina, titania, barium titanate, magnesium titanate, calcium titanate, strontium titanate, zinc oxide, quartz sand, clay, mica, wollastonite, diatomaceous earth, cerium chloride, red iron oxide, chromium oxide, cerium oxide, antimony trioxide, magnesium oxide, zirconia, silicon carbide, and silicon nitride. Among these, silica particles or titania particles may be preferably used and particles subjected to a hydrophobizing process (surface treatment) may be more preferably used.

The inorganic particles are generally used for the purpose of improvement of fluidity. The primary particle diameter of the inorganic particles is preferably in the range of from 1 nm to 200 nm and the amount added thereof is preferably in the range of from 0.01 part by mass to 20 parts by mass with respect to 100 parts by mass of the toner.

The organic particles are generally used for the purpose of improvement in cleaning property or transferability and specific examples thereof include fluorine resin particles such as polyfluorovinylidene and polytetrafluoroethylene, fatty acid metal salts such as zinc stearate and calcium stearate, polystyrene, and polymethyl methacrylate. The amount of the toner added is not particularly limited, but is preferably in the range of from 0.1% by mass to 10% by mass and more preferably in the range of from 0.2% by mass to 8% by mass.

Method of Producing Toner

A method of producing the toner will be described below. The method of producing an electrostatic charge image developing toner according to this exemplary embodiment is not particularly limited, but a production method using an emulsion aggregating method (wet production method) may be preferably used in view of easy control of toner characteristics.

The method of producing an electrostatic charge image developing toner according to this exemplary embodiment will be described below in detail using the emulsion aggregating method.

The method of producing an electrostatic charge image developing toner according to this exemplary embodiment includes a mixing step of mixing at least a dispersion of binder resin particles having a volume-average particle diameter 1 μm or less and containing an amorphous polyester, a dispersion of colorant particles, and a dispersion of release agent particles, an aggregation step of adding an aggregating agent containing aluminum ions to aggregate the binder resin particles, the colorant particles and the release agent particles, a step of adding methylglycine diacetate into the dispersion of the aggregated particles, and a coalescence step of coalescing the aggregated particles to coalesce the aggregated particles at a temperature equal to or higher than a melting point of the binder resin which is a main component of the binder resin particles.

That is, the production method is generally a method of preparing a dispersion (an emulsion) of resin particles such as polyester or the like, mixing the dispersion of colorant particles in which an ionic surfactant is dispersed therein and a dispersion of release agent particles therewith, adding an aggregating agent thereto and stirring the dispersion mixture to cause aggregation, forming aggregated particles with a diameter corresponding to the toner diameter, then adding methylglycine diacetate thereto, coalescing the aggregated particles by heating at a temperature equal to or higher than the glass transition temperature of the resin, and washing and drying the product to obtain a toner. The obtained toner particles may have any shape from an irregular shape to a spherical shape.

An ammonia aqueous solution is preferably added to the dispersion of binder resin particles. Accordingly, ammonia may be included in the toner particles. The amount of ammonia solution added is adjusted so that the content of $NH_4^+$ ions included in the toner is in the range of from 0.05 mg/l to 0.6 mg/l.

The production method is a method of mixing the source material dispersions together and aggregating and coalescing the mixture. Alternatively, balance in amount between polar ionic dispersants may be shifted in advance in an initial stage of the aggregation step, the mixture may be ion-neutralized using an inorganic metal salt including at least aluminum or a polymer including at least aluminum, core aggregated particles may be formed at a temperature equal to or lower than the glass transition temperature and may be stabilized, the product may be stabilized by slightly heating at a temperature equal or lower than the glass transition temperature or the melting temperature of the resin included in the core aggregated particles or the added particles if necessary, a particle dispersion of polarity may be added by an amount suitable for compensating for the shift in balance if necessary in a second step, the product may be stabilized by slightly heating at a high temperature equal to or lower than the glass transition temperature of the resin in the core aggregated particles or added particles if necessary, the methylglycine diacetate may be added thereto, the product may be heated at a temperature equal to or higher than the glass transition temperature, and the result may be coalesced with the particles added in the second step attached to the surfaces of the core aggregated particles. The description will be made below in this order.

The dispersion of resin particles is formed by applying a shearing force to a solution in which an aqueous medium and a mixture solution (polymer solution) including a resin and a colorant and a release agent if necessary are mixed. At this time, by heating the solution at a temperature equal to or higher than the softening point of the resin, the viscosity of the polymer solution is lowered to form the particle dispersion.

Examples of a disperser used to form the dispersion of resin particles include a homogenizer, a homo mixer, a pressure kneader, an extruder, and a media disperser.

In this exemplary embodiment, an example of the dispersion medium of the dispersion of resin particles, the dispersion of colorant particles to be described later, the dispersion of release agent particles, and other components is an aqueous medium.

Examples of the aqueous medium include water such as distilled water and ion-exchanged water and alcohol. These may be used singly or in combination of two or more.

A surfactant may be used for the purpose of dispersion stability of the dispersions. Examples of the surfactant include anionic surfactants such as sulfuric ester salts, sulfonates, phosphoric esters, and soaps, cationic surfactants such as amine salts and quarternary ammonium salts, and nonionic surfactants such as polyethylene glycols, alkylphenolethylene oxide adducts, polyhydric surfactants. Among these, the ionic surfactants may be preferably used, and the anionic surfactants and the cationic surfactants may be more preferably used.

In the toner according to this exemplary embodiment, since an anionic surfactant generally has a strong dispersing force and may superiorly disperse the resin particles and the colorant particles, the anionic surfactant may be advantageously used as the surfactant for dispersing the release agent.

Specific examples of the anionic surfactant include fatty acid soaps such as potassium laurate, sodium oleate, and sodium castor oil, sulfuric esters such as octyl sulfate, lauryl sulfate, lauryl ether sulfate, and nonylphenyl ether sulfate, and alkyl nathphalene sodium sulfonates such as lauryl sulfonate, dodecyl benzene sulfonate, triisopropyl naphthalene sulfonate, and dibutyl naphthalene sulfonate.

Specific examples of the cationic surfactant include amine salts such as laurylamine hydrochloride, stearylamine hydrochloride, oleylamine acetate, and stearylaminopropylamine acetate and quarternary ammonium salts such as lauryltrimethyl ammonium chloride and dilauryldimethyl ammonium chloride.

The nonionic surfactant is preferably used together with the anionic surfactant or the cationic surfactant.

Specific examples of the nonionic surfactant include alkyl esters such as polyoxyethylene octyl ether, polyoxyethylene lauryl ether, polyoxyethylene stearyl ether, and polyoxyethylene oleyl ether and alkylphenyl ethers such as polyoxyethylene octylphenyl ether and polyoxyethylene nonylphenyl ether.

These surfactants may be used singly or in combination of two or more. The content of the surfactant in the dispersions is generally small, preferably in the range of from 0.01% by mass to 1% by mass, preferably in the range of from 0.05% by mass to 0.5% by mass, and still more preferably in the range of from 0.1% by mass to 0.5% by mass. When the content is less than 0.01% by mass, the dispersions such as the dispersion of resin particles, the dispersion of colorant particles, and the dispersion of release agent particles are unstable. Accordingly, since the dispersions cause aggregation or stability of the particles during the aggregation varies, there is a problem in that specific particles may be released. When the content is more than 1% by mass, the size distribution of particles is widened or it is difficult to control the particle diameter, which is not preferable. In general, a suspended and polymerized toner dispersion with a large particle diameter is stability even by the use of a small amount of surfactant.

In addition, water-soluble polymers which are solid at a normal temperature (25° C.) may be used. Specifically, cellulose-based compounds such as carboxymethyl cellulose and hydroxypropyl cellulose, polyvinyl alcohol, gelatin, starch, and gum Arabic are used.

Regarding the particle diameter of the resin particles in the resin particle dispersion in this exemplary embodiment, the volume-average particle diameter is equal to or less than 1 μm and preferably in the range of from 100 nm to 300 nm. When the volume-average particle diameter is more than 1 μm, the size distribution of the toner particles obtained by aggregation and coalescence is widened or released particles are generated, thereby lowering the toner performance or reliability. When the volume-average particle diameter is less than 100 nm, it takes time for the toner to aggregate and grow, which is not suitable industrially. When the volume-average particle diameter is more than 300 nm, the release agent and the colorant are unevenly dispersed and it is difficult to control the toner surface characteristics.

In the aggregation step, the particles in the mixture of the resin particle dispersion, the colorant particle dispersion, and the release agent particle dispersion are aggregated to form aggregated particles. The aggregated particles are formed by heteroaggregation, and an ionic surfactant having a polarity different from that of the aggregated particles or a compound having monovalent or higher charge such as metal salts is added thereto for the purpose of stabilization of the aggregated particles or control of size/size distribution.

As described above, even when the process includes together mixing and aggregation, the initial balance in amount between the polar ionic dispersants is shifted in advance in the aggregation step, the product is ionically neutralized using the ionic surfactant or the compound having monovalent or higher charge such as metal salts, base aggregates in the first stage are formed and stabilized at a temperature equal to or lower than the glass transition temperature, a resin particle dispersion treated with a dispersant with the polarity and amount compensating for the difference in balance in the second stage to coat the particles, the product is heated at a temperature equal to or lower than the glass transition temperature of the resin included in the base or the added particles to stabilize the product at a higher temperature if necessary, and then the product is heated at a temperature equal to or higher than the glass transition temperature, whereby the particles may be coalesced in the state where the particles added in the second stage of the formation of aggregated particles are attached to the surfaces of the base aggregated particles (as attached particles). This step-like aggregating operation may be repeatedly performed multiple times.

In the method of producing an electrostatic charge image developing toner according to this exemplary embodiment, the aggregation is caused by a change in pH in the aggregation step, whereby preparing the particles. An aggregating agent is also added to stably and rapidly aggregate the particles to obtain aggregated particles with a narrower size distribution.

The aggregating agent is not particularly limited, but metal salts of inorganic acids are preferably used in consideration of stability of the aggregated particles, stability of the aggregated particles with heat or elapse of time, and removal during washing. Specific examples thereof include metal salts of inorganic acids such as magnesium chloride, sodium chloride, aluminum sulfate, calcium sulfate, ammonium sulfate, aluminum acetate, silver nitrate, copper sulfate, and sodium carbonate. In this exemplary embodiment, aggregating agents (for example, polyaluminum chloride, aluminum sulfate, and potassium alum) including aluminum are preferably used in view of control of viscosity during fixing final toner particles.

The amount of aggregating agent added varies depending on the valence of charge, but is all small, and is equal to or less than about 0.5% by mass in case of trivalence like aluminum. The amount of aggregating agent is preferably small and thus compounds having high valence may be preferably used.

It is preferable that an attachment step should be performed after the aggregation step. In the attachment step, a coating layer is formed by attaching resin particles to the surfaces of the aggregated particles formed through the aggregation step. Accordingly, it is possible to obtain a toner having a core/shell structure including a so-called core layer and a coating layer with which the core layer is coated.

The coating layer (shell layer) is generally formed by adding a resin particle dispersion containing amorphous polyester resin particles to the dispersion in which the aggregated particles (core particles) are formed in the aggregation step.

In general, the attachment step is used to produce a toner having a so-called core/shell structure mainly containing a release agent and a crystalline polyester resin as a binder resin. The main purpose thereof is to suppress exposure of the release agent contained in the core layer to the toner surface or to compensate for the strength of the toner particles insufficient in the core layer simple.

As the method of controlling viscoelasticity of the toner according to this exemplary embodiment, a method of controlling the content of aluminum in the toner by adjusting the amount of aluminum-containing aggregating agent such as polyaluminum chloride or aluminum sulfate used in the aggregation step or a method of introducing an appropriate amount of chelating agent to capture aluminum ions and to remove complex salts in the coalescence step may be preferably used. In this exemplary embodiment, methylglycine diacetate may be very suitably used as the chelating agent.

After performing the aggregation step or the aggregation step and the attachment step, the aggregated particles are coalesced in the coalescence step. In the coalescence step, the aggregation is stopped by adjusting pH of the suspension of the aggregated particles to the range of from 5 to 10 under the same stirring as the aggregation step, and the solution is heated at a temperature equal to or higher than the highest temperature of the melting temperatures of the crystalline resins contained in the aggregated particles or at a glass transition temperature (the highest glass transition temperature of the resins when the number of types of resins is two or more) of amorphous resin particles (containing the resins forming the shell layer) to coalesce the product, whereby toner particles are obtained. The methylglycine diacetate is added before the coalescence step.

The heating temperature in the coalescence step is not particularly limited as long as it is equal to or higher than the glass transition temperature of the resin. The coalescence may be performed preferably at a temperature equal to or higher than the glass transition temperature of the resin+10° C. and more preferably at a temperature equal to or higher than the glass transition temperature+15° C.

The heating time may be set to achieve the coalescence and is preferably in the range of from 0.2 hour to 10 hours. Thereafter, when the temperature is made to fall at a temperature equal to or lower than the glass transition temperature of the resin to solidify the particles, the particle shapes and surface characteristics may vary depending on the temperature falling rate. For example, when the temperature falls at a high rate, the particles are easily spheroidized and the surfaces are easily smoothed. On the contrary, when the temperature falls in a low rate, the particle shapes are irregular and unevenness is easily formed on the particle surfaces. Accordingly, the temperature falling rate is equal to or higher than 0.5° C./min and preferably equal to or higher than 1.0° C./min.

The coalesced particles are obtained as a toner after the end of the aggregation step and the coalescence step. It is necessary to wash the coalesced particles (toner) through a solid-liquid separation step such as filtration as described later.

After the washing step, the toner particles according to this exemplary embodiment are obtained through the solid-liquid separation step and the drying step. The solid-liquid separation step is not particularly limited, but suction filtration, pressure filtration, and the like may be very suitably used in view of productivity. The drying step is not also particularly limited, but freeze drying, flash-jet drying, fluidized drying, vibration fluidized drying, and the like may be preferably used in view of productivity.

The electrostatic charge image developing toner according to this exemplary embodiment may be produced by forming toner particles (base particles) as described above, adding the inorganic particles to the formed toner particles, and mixing the mixture by the use of a Henschel mixer, a sample mill, and the like.

Electrostatic Charge Image Developer

The electrostatic charge image developer according to this exemplary embodiment is not particularly limited as long as it includes the electrostatic charge image developing toner according to this exemplary embodiment, and may have component compositions corresponding to the purposes. The electrostatic charge image developer according to this exemplary embodiment is a single-component electrostatic charge image developer when the electrostatic charge image developing toner is used singly, and is a two-component electrostatic charge image developer when it is used in combination with a carrier.

For example, in case of the two-component developer, the carrier is not particularly limited and known carriers may be used. Examples thereof include known carriers such as resin-coated carriers described in JP-A-62-39879 and JP-A-56-11461.

Specific examples of the carrier include the following resin-coated carriers. Examples of core particles of the carrier include normal iron particles and ferrite or magnetite particles. The volume-average particle diameter thereof is in the range of from 30 μm to 200 μm.

Examples of the coating resin of the resin-coated carrier include styrenes such as styrene, p-chlorostyrene, and α-methyl styrene, α-methylene monocarboxylic fatty acids such as methyl acrylate, ethyl acrylate, n-propyl acrylate, lauryl acrylate, 2-ethylhexyl acrylate, methyl methacrylate, n-propyl methacrylate, lauryl methacrylate, 2-ethylhexyl methacrylate, and cyclohexyl mechacrylate, nitrogen-containing acryls such as dimethylaminoethyl methacrylate, vinyl nitriles such as acrylonitrile and methacrylonitrile, vinylpyridines such as 2-vinylpyridine and 4-vinylpyridine, vinyl ethers such as vinylmethyl ether and vinylisobutyl ether, vinyl ketones such as vinylmethyl ketone, vinylethyl ketone, and vinylisopropenyl ketone, olefins such as ethylene and propylene, homopolymers of vinyl-based fluorine-containing monomers such as vinylidene fluoride, tetrafluoroethylene, and hexafluoroethylene or copolymers of two or more monomers thereof, silicone resins including methyl silicone, methylphenyl silicone, and the like, polyesters including bisphenol, glycol, and the like, and an epoxy resin, a polyurethane resin, a polyamide resin, a cellulose resin, a polyester resin, and a polycarbonate resin.

These resins may be used singly or in combination of two or more.

The coating amount of the coating resin is preferably in the range of from 0.1 part by mass to 10 parts by mass with respect to 100 parts by mass of the core particles and more preferably in the range of from 0.5 part by mass to 3.0 parts by mass.

A heating kneader, a heating Henschel mixer, a UM mixer, and the like are used to produce the carrier, and a heating rolling floor, a heating kiln, and the like are used depending on the amount of the coating resin.

The mixing ratio (mass ratio) of the electrostatic charge image developing toner according to this exemplary embodiment and the carrier in the two-component electrostatic charge image developer is not particularly limited and may be selected depending on the purposes, but is preferably in the toner: carrier range of 1:100 to 30:100 and more preferably in the range of 3:100 to 20:100.

Toner Cartridge, Process Cartridge, Image Forming Apparatus, and Image Forming Method A toner cartridge, process cartridge, image forming apparatus, and image forming method, employing the electrostatic charge image developing toner according to this exemplary embodiment, respectively, will be described below.

The image forming apparatus according to this exemplary embodiment includes an image holding member, a charging unit that charges a surface of the image holding member, a latent image forming unit that forms an electrostatic latent image on the surface of the image holding member, a developing unit that develops the electrostatic latent image formed on the image holding member with a developer to form a toner image, and a transfer unit that transfers the toner image formed on the image holding member to a transfer medium, and employs the electrostatic charge image developer according to this exemplary embodiment as the developer. The image forming apparatus according to this exemplary embodiment may include units other than the above-mentioned units, such as a fixing unit that fixes the toner image transferred to the transfer medium and a cleaning unit that removes the toner remaining on the surface of the image holding member. An example of the image forming apparatus according to this exemplary embodiment will be described below, but the invention is not limited to the example.

In the image forming apparatus, for example, a part including the developing unit may be a cartridge structure (process cartridge) that is detachable from the image forming apparatus body. The process cartridge includes at least a developer holding member to contain the electrostatic charge image developer according to this exemplary embodiment.

The exemplary configuration of the image forming apparatus according to this exemplary embodiment is shown in FIG. 1 and will be described below with reference thereto. The image forming apparatus 1 includes a charging device 10, an exposing device 12, an electrophotographic photoreceptor 14 as the image holding member, a developing device 16, a transfer device 18, a cleaning device 20, and a fixing device 22.

In the image forming apparatus 1, the charging device 10 as the charging unit that charges the surface of the electrophotographic photoreceptor 14, the exposing device 12 as the electrostatic charge image forming unit that exposes the charge electrophotographic photoreceptor 14 to form an electrostatic charge image (electrostatic latent image) on the basis of image information, the developing device 16 as the developing unit that develops the electrostatic charge image with a toner to form a toner image, the transfer device 18 as the transfer unit that transfers the toner image formed on the surface of the electrophotographic photoreceptor 14 to the surface of a transfer medium 24, and the cleaning device 20 as the cleaning unit that removes the toner remaining on the surface of the electrophotographic photoreceptor 14 after the transferring are arranged around the electrophotographic photoreceptor 14 in this order. The fixing device 22 as the fixing unit that fixes the toner image transferred to the transfer medium 24 is arranged on the left side of the transfer device 18 in FIG. 1.

The operation of the image forming apparatus 1 according to this exemplary embodiment will be described below. First, the surface of the electrophotographic photoreceptor 14 is uniformly charged by the charging device 10 (charging step). Then, the surface of the electrophotographic photoreceptor 14 is irradiated with light by the exposing device 12 and the charge of the part irradiated with light is removed to form an electrostatic charge image (electrostatic latent image) on the basis of image information (electrostatic charge image forming step). Thereafter, the electrostatic charge image is developed by the developing device 16 and a toner image is formed on the surface of the electrophotographic photoreceptor (developing step). For example, in case of a digital electrophotographic copier using an organic photoreceptor as the electrophotographic photoreceptor 14 and using a laser beam for the exposing device 12, negative charges are given to the surface of the electrophotographic photoreceptor 14 by the charging device 10, a dotted digital latent image is formed with a laser beam, the toner is applied to the part irradiated with the laser beam by the developing device 16 to visualize an image. In this case, a minus bias is applied to the developing device 16. Then, a transfer medium 24 such as a sheet of paper is carried on the toner image at the transfer device 18, charges of a polarity opposite to that of the toner is given to the transfer medium 24 from the rear side of the transfer medium 24, and the toner image is transferred to the transfer medium 24 by an electrostatic force (transfer step). Then, the transferred toner image is fused and fixed to the transfer medium 24 by heat and pressure applied from a fixing member of the fixing device 22 (fixing step). On the other hand, the toner not being transferred but remaining on the surface of the electrophotographic photoreceptor 14 is removed by the cleaning device 20 (cleaning step). A cycle is finished through a series of processes from the charging to the cleaning. In FIG. 1, the toner image is transferred directly to the transfer medium 24 such as a sheet of paper by the transfer device 18, but may be transferred via a transfer member such as an intermediate transfer member.

The charging unit, the image holding member, the exposing unit, the developing unit, the transfer unit, the cleaning unit, and the fixing unit in the image forming apparatus 1 shown in FIG. 1 will be described below.

Charging Unit

A charger such as a corotron is used as the charging device 10 as the charging unit and a conductive or semiconductive charging roll may be used. A contact charger using the conductive or semiconductive charging roll may apply a DC current to the electrophotographic photoreceptor 14 or may apply an AC current to overlap therewith. For example, the surface of the electrophotographic photoreceptor 14 is charged by the charging device 10 by generating a discharge in a small space around the contact part with the electrophotographic photoreceptor 14. In general, the surface of the electrophotographic photoreceptor 14 is charged to −300 to −1000 V. The conductive or semiconductive charging roll may have a single-layered structure or a multi-layered structure. A mechanism cleaning the surface of the charging roll may be provided.

Image Holding Member

The image holding member has at least a function of allowing an electrostatic charge image (electrostatic latent image) to be formed thereon. The electrophotographic photoreceptor 14 may be very suitably used as the image holding member. The electrophotographic photoreceptor 14 has a coating film including an organic photosensitive layer on the outer peripheral surface of a cylindrical conductive base member. The coating film has an undercoat layer and a photosensitive layer including a charge generating layer including a charge generating material and a charge transporting layer containing a charge transporting material formed if necessary on the base member in this order. The stacking order of the charge generating layer and the charge transporting layer may be inverted. This is a multi-layered photoreceptor in which a charge generating material and a charge transporting material are included in separated layers (the charge generating layer and the charge transporting layer) and stacked, but a single-layered photoreceptor including both the charge generating material and the charge transporting material in the same layer may be used. The multi-layered photoreceptor is preferable. An intermediate layer may be interposed between the undercoat layer and the photosensitive layer. Other types of photosensitive layers such as an amorphous silicon photosensitive film may be used without being limited to the organic photoreceptor.

Exposing Unit

The exposing device 12 as the exposing unit is not particularly limited and, for example, an optical device that may expose the surface of the image holding member with a light source such as a semiconductor laser beam, an LED beam, and a liquid crystal shutter beam into a desired image shape may be used.

Developing Unit

The developing device 16 as the developing unit has a function of developing an electrostatic charge image formed on the image holding member with the developer including the toner to form a toner image. The developing device is not particularly limited as long as it has the above-mentioned function, and may be appropriately selected depending on the purposes thereof. For example, a known developing device having a function of attaching the electrostatic charge image developing toner to the electrophotographic photoreceptor 14 using a brush, a roller, or the like may be used. A DC voltage is normally used for the electrophotographic photoreceptor 14, but an AC current may be superimposed thereon.

Transfer Unit

Examples of the transfer device 18 as the transfer unit include a transfer device applying charges of a polarity opposite to that of the toner to the transfer medium 24 from the rear side of the transfer medium 24 shown in FIG. 1 and transferring the toner image to the transfer medium 24 by an electrostatic force and a transfer device including a transfer roll such as a conductive or semiconductive roll that is directly contact with the surface of the transfer medium 24 transferring an image to the transfer medium 24 and a transfer roll pressing device. A DC current may be applied to the transfer roll as a transfer current given to the image holding member or an AC current may be superimposed thereon. The transfer roll may be freely set depending on the width of an image area to be charged, the shape of the transfer charger, the aperture width, the process speed (peripheral speed), and the like. A single-layered foamed roll or the like may be very suitably used as the transfer roll for the purpose of a decrease in cost. Regarding the transfer method, a method of directly transferring an image to the transfer medium 24 such as a sheet of paper or a method of transferring an image to the transfer medium 24 via an intermediate transfer member may be employed.

A known intermediate transfer member may be used as the intermediate transfer member. Examples of the material of the intermediate transfer member include a polycarbonate resin (PC), polyfluorovinylidene (PVDF), polyalkylene terephthalate, a mixed material of PC/polyalkylene terephthalate (PAT), and mixed materials such as ethylene tetrafluoroetheylene copolymer (ETFE)/PC, ETFE/PAT, PC/PAT, polyimide, polyamide and polyamide-imide. An intermediate transfer belt formed of a thermosetting polyimide resin may be preferably used in view of mechanical strength.

Cleaning Unit

The cleaning device 20 as the cleaning unit is not particularly limited as long as it may clean the toner remaining on the image holding member, and a blade cleaning type, a brush cleaning type, a roll cleaning type, and the like may be appropriately selected. Among these, the cleaning blade is preferably used. Examples of the material of the cleaning blade include urethane rubber, neoprene rubber, and silicone rubber. Among these, a polyurethane elastic material may be preferably used because it is superior in abrasion resistance. Here, the cleaning device 20 may not be used when a toner having a high transfer efficiency is used.

Fixing Unit

The fixing device 22 as the fixing unit (image fixing device) serves to fix a toner image transferred to the transfer medium 24 thereto by heating, pressurizing, or heating and pressurizing and includes a fixing member.

Transfer Medium

Examples of the transfer medium (sheet of paper) 24 onto which a toner image is transferred include regular sheets of paper and OHP sheets used for an electrophotographic copier or printer. When it is intended to further improve the smoothness of the image surface after the fixation, the surface of the transfer medium is preferably as smooth as possible, and a coated sheet of paper or a print art sheet of paper in which the surface of a regular sheet of paper is coated with a resin or the like may be very suitably used.

In the example shown in FIG. 1, a single electrophotographic photoreceptor 14 is shown, but the invention is not limited to this configuration. For example, a four-tandem type which are provided with four sets each including the charge device 10, the exposing device 12, the electrophotographic photoreceptor 14, the developing device 16, the transfer device 18, and the cleaning device 20 and which transfers color toner images of C, M, Y, and K to the intermediate transfer member and then transfers and fixes the color image to the transfer medium may be employed.

The charging device 10, the developing device 16, and the cleaning device 20 along with the electrophotographic photoreceptor 14 may be incorporated into a body to constitute a process cartridge which is detachable from the body of the image forming apparatus 1.

The image forming apparatus 1 according to this exemplary embodiment may be very suitably provided with a toner cartridge that is detachable from the image forming apparatus 1 and that contains at least the toner to be supplied to the developing device 16 disposed in the image forming apparatus 1. The above-mentioned toner according to this exemplary embodiment is used as the toner in this case. The toner cartridge according to this exemplary embodiment has only to contain at least the toner, and may contain, for example, an electrostatic charge image developer depending on the mechanisms of the image forming apparatus.

Therefore, in the image forming apparatus 1 having the configuration from which the toner cartridge is detachable, the toner according to this exemplary embodiment may be easily supplied to the developing unit by employing the toner cartridge containing the toner according to this exemplary embodiment.

According to the image forming apparatus according to this exemplary embodiment, an image forming method is performed that includes: a charging process of charging a surface of an image holding member; an electrostatic latent image forming process of forming an electrostatic latent image on the surface of the image holding member; a developing process of developing the electrostatic latent image formed on the surface of the image holding member with the developer for electrostatic charge development according to this exemplary embodiment to form a toner image; and a transfer process of transferring the toner image onto a transfer medium. The image forming method may further include a fixing process of fixing the toner image of the recording medium.

EXAMPLES

The invention will be described in more detail with reference to examples and comparative examples but the invention is not limited to the following examples. The simple terms, "parts" and "%", are all based on mass as long as they are differently mentioned.

Measurement of Ion Content

The $Na^+$ ion content and the $NH_4^+$ ion content in the toner are measured as follows.

First, the toner (so-called toner particles, not an externally-added toner) to be measured is weighed by 0.5 g, is dispersed in 100 g of an ion-exchange water to which 0.1 g of a nonionic surfactant (NONIPOL 10, made by Sanyo Chemical Industries, Ltd.) corresponding to 20% of a toner solid content is added, and the dispersion is dispersed in a thermostatic bath controlled at 30±1° C. for 30 minutes by the use of an ultrasonic disperser.

The solution having been subjected to the ultrasonic dispersing process is separated into solid and liquid by suction filtration, the solid toner is removed, and the obtained filtrate is measured through the use of ion chromatography. In the ion chromatography, the filtrate is analyzed using ICS-2000 made by Dionex Japan under the following conditions.

Anion separating column: IonPac CS12A, made by Dionex Japan

Anion guiding column: IonPac CG12A, made by Dionex Japan

Eluant: 20 mM (mmol/l) of methane sulfonate aqueous solution

Flow rate: 1 ml/min

Temperature: 35° C.

Detection method: conductivity method (suppressor type)

Measurement of Aluminum Content

The aluminum content in the toner is measured as follows. That is, a fluorescent X-ray analyzer (XRF-1500, made by Shimadzu Corporation) is used, 0.3 g of the toner as a sample is formed in a cylinder shape with a diameter of 10 mm, the composition ratio in terms of mass is calculated in consideration of element mass from the net intensity obtained by total element analysis under conditions of a tube voltage of 40 kV, a tube current of 70 mA, a measuring area of 10 mmϕ, and a measuring time of 15 minutes, and the aluminum content is calculated.

Measurement of Methylglycine Diacetate Content

The content of methylglycine diacetate in the toner is measured as follows.

(1) 0.1 g of the toner, 0.1 g of a 20% surfactant (Tayca Power), and 50 mL of a 0.5 M (mol/l) NaOH solution are mixed and stirred by the use of a ball mill at 28° C. for 2 hours.

(2) Thereafter, the product of (1) is separated by the use of a centrifugal machine at 2000 rpm for 30 minutes.

(3) The supernatant liquid obtained in (2) is subjected to solid-liquid separation using a filter paper based on the JIS standard 5A.

(4) 8.5 mL of the filtrate obtained in (3) and 1.0 mL of an acetic acid buffer solution (in which 20.0 mL of 1 M acetic acid, 30.0 mL of 1 M sodium acetate, and 100 mL of ion-exchange water are sufficiently mixed) are sufficiently mixed.

(5) The contents in the sample obtained in (4) are measured by the use of high-speed liquid chromatography (HPLC) under the following conditions.

Analyzer: Lachrom Elite L2000 series, made by Hitachi High-Technologies Corporation Column: HITACHI GL W520 S (ϕ7.8 mm×300 mm)

Detector: L 2455 type diode array detector

Measuring wavelength: UV190 400 nm, quantitative wavelength: UV284 nm

Mobile phase: 50 mM dibasic potassium phosphate aqueous solution

Solution feed rate: 1.0 mL/min

Amount of sample introduced: 10 μL

Column temperature: 50° C.

Content of methylglycine diacetate included in the dispersion (ppm)=amount of methylglycine diacetate detected by HPLC (ppm)×(50÷8.5)

Measurement of Acid Value

The acid value AV is measured by a neutralization titration method in accordance with JIS K0070. That is, an appropriate amount of sample is partly taken, 160 ml of a solvent (acetone/toluene mixture) and several droplets of indicator (phenolphthalein solution) are added thereto, and the resulting product is sufficiently shaken and mixed in a water bath until the sample is completely dissolved. The resulting product is titrated with 0.1 mol/l potassium hydroxide ethanol solution and the titration is ended when the light red of the indicator is continued for 30 seconds.

When the acid value A, the amount of sample is Sg, the amount of the 0.1 mol/l potassium hydroxide ethanol solution used in the titration is B ml, and f represents a factor of the 0.1 mol/l potassium hydroxide ethanol solution, the acid value A is calculated by A=(B×f×5.611)/S.

Measurement of Glass Transition Temperature and Melting Temperature

The glass transition temperature and the melting temperature are measured through the use of the differential scanning colorimetry based on ASTMD 3418-8. The measurement is as follows.

That is, a material as a measurement target is set in a differential scanning calorimeter (DSC-50 type) made by Shimadzu Corporation including an automatic tangent processing system, liquid nitrogen is set as a coolant, the material is heated from 0° C. to 150° C. at a temperature rising rate of 10° C./min (first temperature raising step), the relationship between the temperature (° C.) and the calorie (mW) is calculated, the material is then cooled to 0° C. at a temperature falling rate of −10° C./min, the material is heated again to 150° C. at a temperature rising rate of 10° C./min (second temperature raising step), and data is taken. The material is held at 0° C. and 10° C. for 10 minutes.

The melting temperature of a mixture of indium and zinc is used to correct the temperature of a detection unit of a meter and the melting heat of indium is used to correct the amount of heat. The sample is input to an aluminum pan and the aluminum pan having the sample input thereto and an empty aluminum pan for comparison are set.

Regarding the glass transition temperature of the toner, the temperature of an intersection of a base line and an extension of a rising line in an endothermic part of a DSC curve obtained in the first temperature rising process is used as the glass transition temperature.

Regarding the glass transition temperature of the amorphous resin, the temperature of an intersection of a base line and an extension of a rising line in an endothermic part of a DSC curve obtained in the second temperature rising process is used as the glass transition temperature.

Regarding the melting point of the crystalline resin, the temperature of the maximum peak out of peaks with an absorbed heat amount of 25 J/g or more in the DSC curve obtained in the second temperature rising process is used as the melting point.

Measurement of Weight-Average Molecular Weight (Mw)

The weight-average molecular weight (Mw) of the polyester resin (in terms of polystyrene) is measured using HLC-8120 GPC and SC-8020 made by Tosoh Corporation as a GPC apparatus, using TSKgei SuperHM-H (6.0 mmID×15 cm×2) as a column, and using THF (TetraHydroFuran) for chromatography made by Wako Pure Chemical Industries, Co. Ltd. as an eluant. The measuring conditions include a sample concentration of 0.5%, a flow rate of 0.6 ml/min, an amount of sample introduced of 10 μl, and a measuring temperature of 40° C., and a calibration curve is prepared from ten samples of A-500, F-1, F-10, F-80, F-380, A-2500, F-4, F-40, F-128, and F-700. A data collection interval in the sample analysis is 300 ms.

Measurement of Half-Fall Temperature

The flow tester half-fall temperature of the polyester resin is measured using a flow tester CFT-500 C made by Shimadzu Corporation and using conditions of an amount of sample of 1.05 g, a sample diameter of 1 mm, a preheating at 65° C. for 300 seconds, a weight of 10 kg, a die diameter of 0.5 mm, and a temperature rising rate of 1.0° C./min and the temperature when a fall of a plunger is plotted and a half of the sample is discharged is defined as a half-fall temperature.

Measurement of Tan δ when Viscosity of Toner is 10000 Pa.s tan δ when the viscosity of the toner is 10000 Pa.s is measured using Rheo meter "ARES" (RHIOS system Ver. 6.4.4) which is a product name made by Rheometric Scientific Inc. Parallel plates with a diameter of 8 mm are used, a toner formed in a diameter of 8 mm and a thickness of 4 mm which is melted at a temperature of 100° C. to 150° C. on a hot plate in advance is interposed between the parallel plates, and the viscosity is measured through the use of sinusoidal vibration. The dynamic viscoelasticity is measured at a frequency of 6.28 rad/s while raising the temperature at 2° C./min in the range of from 30° C. to 180° C. The measurement is performed while changing the distortion from an initial value of 0.005% in an automatic measurement mode with a maximum value of 5%, and tan δ (a value obtained by dividing the loss elastic modulus by the storage elastic modulus) when the complex viscosity (a value obtained by dividing a square root of the sum of squares of the storage elastic modulus and the loss elastic modulus by the measuring frequency) is 10000 Pa.s is calculated from the measured data.

Calculation of Shape Factor Sf1

The shape factor of the toner is measured using FPIA-3000 (made by Sysmex Corporation). A toner dispersion for measurement is produced as follows. 30 ml of ion-exchange water is introduced into a 100 ml beaker and two droplets of a surfactant (Contaminon, made by Wako Pure Chemical Industries Co., Ltd.) as a dispersant are dropped thereon. 20 mg of the toner is added to the solution and the solution is dispersed for 3 minutes through the use of ultrasonic dispersion, whereby a dispersion is produced.

The measurement is performed on 4500 particles in the obtained toner dispersion by the use of FPIA-3000 to calculate the shape factor.

Measurement of Volume-Average Particle Diameter/Size Distribution of Toner

The volume-average particle diameter of the toner particles is measured by the use of Multisizer-II (made by Beckman Coulter Inc.). ISOTON-II (made by Beckman Coulter Inc.) is used as an electrolyte.

The accumulation distributions of the volume and the number are drawn from the smallest diameter in the size ranges (channels) into which the measured size distribution is divided, the particle diameter at which the accumulated volume is 16% is defined as D16v, the particle diameter at which the accumulated number is 16% is defined as D16p, the particle diameter at which the accumulated volume is 50% is defined as D50v, the particle diameter at which the accumulated number is 50% is defined as D50p, the particle diameter at which the accumulated volume is 84% is defined as D84v, and the particle diameter at which the accumulated number is 84% is defined as D84p.

By using these measured values, the volume-average size distribution index (GSDv) is calculated by $(D84v/D16v)^{1/2}$, the number-average size distribution index (GSDp) is calculated by $(D84p/D16p)^{1/2}$, and the lower number-average size distribution index (GSDp-lower) is calculated by $(D50p/D16p)^{1/2}$.

Evaluation of Fixing Characteristics

A developing device of a color copier DocuCentre Color500 (made by Fuji Xerox Co., Ltd.) from which a fixing device is removed is filled with electrostatic charge image developers using the following toners, respectively. The amount of toner filled is adjusted to be 0.50 mg/cm$^2$ and a non-fixed image is printed out. The printed-out image is a solid image of which the image density of 50 mm×50 mm is 100% and "C2r" (made by Fuji Xerox Co., Ltd.) is used as a sheet of paper.

Regarding the fixation of an image, the fixing device removed from the color copier DocuCentre Color500 (made by Fuji Xerox Co., Ltd.) is modified so as to change the roll temperature of the fixing device, a sheet transport speed of the fixing device is set to 200 mm/second, and the non-fixed image is fixed under these conditions while changing the temperature of the fixing device by 5° C. from 100° C. to 210° C., whereby a fixed image is obtained.

A hot offset temperature (hereinafter, referred to as HOT) which is a higher temperature than the lowest fixing temperature (which is the lowest temperature at which a low-temperature offset does not occur and of which the lower value means that the low-temperature fixability is superior) and at which an offset occurs is evaluated.

By using the above-mentioned device, an image is fixed to two types of sheets with different basis weights, "C2r" (made by Fuji Xerox Co., Ltd.) and "Business 4200 Paper" (made by Fuji Xerox Co., Ltd.), at a fixing temperature of the lowest fixing temperature, which is evaluated using the sheet "C2r", +25° C. and then the difference in gloss between the images is evaluated. The gloss is measured using a gloss meter GM-26D (made by Murakami Color Research Laboratory) under a condition that the angle of incident light on the samples is 75 degrees.

In Table 1 described later, a case where the difference in gloss between the thin paper (C2r) and the thick paper (Business 4200 Paper) is less than 1.5 degree is evaluated as AA, a case where the difference in gloss is equal to or more than 1.5 degree and less than 2.5 degree is evaluated as A, a case where the difference in gloss is equal to or more than 2.5 degree and less than 3.5 degree is evaluated as B, a case where the difference in gloss is equal to or more than 3.5 degree and less than 5.0 degree is evaluated as C, and a case where the difference in gloss is equal to or more than 5.0 is evaluated as D.

Preparation of Colorant Dispersion (PDK1)

- Carbon black (REAGAL 330, made by Cabot Japan K.K.): 200 parts by mass
- Anionic surfactant (Neogen SC, made by Dai-Ichi Kogyo Seiyaku Co., Ltd.): 33 parts by mass (60% by mass as an effective component and 10% by mass with respect to the colorant)
- Ion-exchange water: 750 parts by mass The anionic surfactant and 280 parts by mass of the ion-exchange water are input to a stainless vessel with such a size that the liquid level is about ⅓ of the height of the vessel when all the above materials are input thereto, the surfactant is sufficiently dissolved while raising the temperature to 40° C., the carbon black is then input thereto, the solution is stirred by the use of a stirrer until a pigment not being wet disappears, the other ion-exchange water is added thereto, and the solution is further stirred to sufficiently defoam the solution.

After the defoaming, the solution is dispersed at 5000 rpm for 10 minutes by the use of a homogenizer (ULTRA-TURRAX T50, made by IKA Co., Ltd.) and is stirred and defoamed for a day and night by the use of a stirrer. After the defoaming, the solution is dispersed at 6000 rpm for 10 minutes by the use of the homogenizer again and then is stirred and defoamed for a day and night by the use of a stirrer.

After the defoaming, the solution is dispersed at a pressure of 240 MPa by the use of a high-pressure impact disperser Ultimaizer (HJP 30006, made by Sugino Machine Ltd.). The dispersing is performed by 25 passes in terms of the total amount of materials and the machine capacity.

The obtained dispersion is left for 72 hours without doing any thing, the precipitate is removed, and the ion-exchange water is added thereto to adjust the solid concentration to 15% by mass, whereby a colorant dispersion (PDK1) is obtained. The volume-average particle diameter D50v of particles in the colorant dispersion is 110 nm. The average value of three measured values other than the maximum value and the minimum value out of five measured values measured by a micro track is used as the volume-average particle diameter D50v.

Preparation of Release Agent Dispersion (DW1)

- Hydrocarbon wax (product name: FNP0090, made by Nippon Seiro Co., Ltd., with a melting temperature of Tw=90.2° C.): 270 parts by mass
- Anionic surfactant (Neogen RK, made by Dai-Ichi Kogyo Seiyaku Co., Ltd., with an effective content of 60% by mass): 13.5 parts by mass (3.0% by mass with respect to the release agent as an effective component)
- Ion-exchange water: 700 parts by mass The materials are mixed, the release agent is dissolved at an intra-solution temperature of 120° C. by the use of a pressure-discharged homogenizer (Gaulin Homogenizer, made by Gaulin Co., Ltd.), the solution is processed at a dispersing pressure of 5 Mpa for 120 minutes and continuously processed at 40 Mpa for 360 minutes, and the solution is then cooled, whereby a release agent dispersion is obtained. The volume-average particle diameter D50v of particles in the release agent dispersion is 220 nm. Thereafter, the ion-exchange water is added thereto to adjust the solid concentration to 20.0% by mass, whereby a release agent dispersion (DW1) is obtained.

Synthesis of Amorphous Polyester Resin (PES-A1)

Monomers are input to a reaction vessel equipping with a stirrer, a thermometer, a condenser, and a nitrogen-introducing pipe on the basis of the composition (mol %) shown in Table 1, the inside of the reaction vessel is replaced with dry nitrogen gas, tin dioctanoate corresponding to 0.3% by mass with respect to the total amount of the monomers is then input thereto. The material is stirred to react at about 180° C. for about 6 hours under a nitrogen gas flow, the temperature is raised to about 220° C. for 1 hour, the material is stirred to react for about 7.0 hours, the temperature is raised to 235° C., the reaction vessel is depressurized to 10.0 mmHg (1.33 kPa), and the reaction is ended when a desired molecular weight is reached. The physical properties of the obtained amorphous polyester resin (PES-A1) are shown in Table 1.

Synthesis of Amorphous Polyester Resin (PES-A2)

Monomers other than trimellitic anhydride are input to a reaction vessel equipping with a stirrer, a thermometer, a condenser, and a nitrogen-introducing pipe on the basis of the composition (mol %) shown in Table 1, the inside of the reaction vessel is replaced with dry nitrogen gas, tin dioctanoate corresponding to 0.3% by mass with respect to the total amount of the monomers is then input thereto. The material is stirred to react at about 180° C. for about 6 hours under a nitrogen gas flow, the temperature is raised to about 235° C. for 1 hour, the reaction product is made to react for about 3 hours, the temperature is lowered to 220° C., the reaction vessel is depressurized to 10.0 mmHg (1.33 kPa), and the reaction product is made to react for about 1 hour. The pressure is returned to a normal pressure, trimellitic anhydride shown in Table 1 is added thereto to react, and the reaction is ended when a desired molecular weight is reached. The physical properties of the obtained amorphous polyester resin (PES-A2) are shown in Table 1.

Synthesis of Amorphous Polyester Resin (PES-A3)

Monomers other than dodecenyl succinate are input to a reaction vessel equipping with a stirrer, a thermometer, a condenser, and a nitrogen-introducing pipe on the basis of the composition (mol %) shown in Table 1, the inside of the reaction vessel is replaced with dry nitrogen gas, tin dioctanoate corresponding to 0.3% by mass with respect to the total amount of the monomers is then input thereto. The material is stirred to react at about 180° C. for about 6 hours under a nitrogen gas flow, the temperature is raised to about 235° C. for 1 hour, the reaction product is made to react for about 3 hours, the temperature is lowered to 220° C., the reaction vessel is depressurized to 10.0 mmHg (1.33 kPa), and the reaction product is made to react for about 1 hour. The pressure is returned to a normal pressure, dodecenyl succinate shown in Table 1 is added thereto to react, and the reaction is ended when a desired molecular weight is reached. The physical properties of the obtained amorphous polyester resin (PES-A3) are shown in Table 1.

Synthesis of Amorphous Polyester Resin (PES-A4)

Monomers other than dodecenyl succinate and trimellitic anhydride are input to a reaction vessel equipping with a stirrer, a thermometer, a condenser, and a nitrogen-introducing pipe on the basis of the composition (mol %) shown in Table 1, the inside of the reaction vessel is replaced with dry nitrogen gas, tin dioctanoate corresponding to 0.3% by mass with respect to the total amount of the monomers is then input thereto. The material is stirred to react at about 180° C. for about 6 hours under a nitrogen gas flow, the temperature is raised to about 235° C. for 1 hour, the reaction product is made to react for about 3 hours, the temperature is lowered to 220° C., the reaction vessel is depressurized to 10.0 mmHg (1.33 kPa), and the reaction product is made to react for about 1 hour. The pressure is returned to a normal pressure, dodecenyl succinate shown in Table 1 is added thereto, the reaction product is made to react for about 2 hours, trimellitic anhydride is added to react, and the reaction is ended when a desired molecular weight is reached. The physical properties of the obtained amorphous polyester resin (PES-A4) are shown in Table 1.

Synthesis of Amorphous Polyester Resin (PES-A5)

Monomers are input on the basis of the compositions shown in Table 1 and an amorphous polyester resin (PES-A5) is synthesized in the same way as synthesizing the amorphous polyester resin (PES-A4). The physical properties of the obtained amorphous polyester resin (PES-A5) are shown in Table 1.

Synthesis of Amorphous Polyester Resin (PES-A6)

Monomers are input on the basis of the compositions shown in Table 1 and an amorphous polyester resin (PES-A6) is synthesized in the same way as synthesizing the amorphous polyester resin (PES-A1). The physical properties of the obtained amorphous polyester resin (PES-A6) are shown in Table 1.

Synthesis of Crystalline Polyester Resin (PES-C1)

Monomers are input to a reaction vessel equipping with a stirrer, a thermometer, a condenser, and a nitrogen-introducing pipe on the basis of the compositions (mol %) shown in Table 1, the inside of the reaction vessel is replaced with dry nitrogen gas, titanium tetrabutoxide (indicator) corresponding to 0.3% by mass with respect to 100 parts by mass of the monomers is then input thereto. The material is stirred to react at about 170° C. for about 3 hours under a nitrogen gas flow, the temperature is raised to about 210° C. for 1 hour, the reaction vessel is depressurized to 3 kPa, and the reaction is ended when a desired molecular weight is reached. The physical properties of the obtained crystalline polyester resin (PES-C1) are shown in Table 1.

Synthesis of Crystalline Polyester Resin (PES-C2)

Monomers are input on the basis of the compositions shown in Table 1 and a crystalline polyester resin (PES-C2) is synthesized in the same way as synthesizing the crystalline polyester resin (PES-C1). The physical properties of the obtained crystalline polyester resin (PES-C2) are shown in Table 1.

TABLE 1 unit is mol %

| | PES-A1 | PES-A2 | PES-A3 | PES-A4 | PES-A5 | PES-A6 | PES-C1 | PES-C2 |
|---|---|---|---|---|---|---|---|---|
| Bisphenol A-propylene oxide adduct | 80.0 | 70.0 | 80.0 | 60.0 | 60.0 | 65.0 | | |
| Bisphenol A-ethylene oxide adduct | 20.0 | 30.0 | 20.0 | 40.0 | 40.0 | 25.0 | | |
| 1,9-nonane diol | | | | | | | 100.0 | |
| 1,6-hexane diol | | | | | | | | 100.0 |
| Dimer diol | | | | | | 10.0 | | |
| Terephthalic acid | 65.0 | 53.0 | 70.0 | 58.0 | 55.0 | 70.0 | | |
| Isophthalic acid | 10.0 | 10.0 | | | | 30.0 | | |
| Cyclohexane dicarboxylic acid | 10.0 | 30.0 | 5.0 | | | | | |
| Fumaric acid | 15.0 | | 5.0 | | | | | |
| Trimellitic anhydride | | 7.0 | | 7.0 | 10.0 | | | |
| dodecenyl succinate | | | 20.0 | 35.0 | 35.0 | | | |
| Dodecanedioic acid | | | | | | | 100.0 | 100.0 |
| Total amount of monomers | 200.0 | 200.0 | 200.0 | 200.0 | 200.0 | 200.0 | 200.0 | 200.0 |
| Glass transition temperature [° C.] | 57.5 | 58.0 | 56.0 | 57.0 | 58.0 | 59.0 | | |
| Crystal melting point [° C.] | | | | | | | 74.0 | 70.0 |
| Mw | 16000 | 90000 | 17000 | 95000 | 140000 | 15000 | 18000 | 30000 |
| Mn | 6000 | 7800 | 6000 | 8200 | 10000 | 5500 | 7000 | 12000 |
| Mp | 14000 | 16000 | 14000 | 16000 | 18000 | 13000 | 18000 | 28000 |
| Acid value [mgKOH/g] | 12.0 | 13.5 | 11.5 | 13.0 | 15.5 | 14.0 | 15.0 | 9.0 |
| Half-fall temperature [° C.] | 104.0 | 118.0 | 105.0 | 120.0 | 128.0 | 101.0 | | |

Preparation of Amorphous Polyester Resin Particle Dispersion (DA-A1)

A jacketed 3-liter reaction vessel (BJ-30N, made by Tokyo Rikakikai Co., LTD.) equipping with a condenser, a thermometer, a water dropping device, and an anchor blade is maintained at 40° C. by the use of a water-circulation thermostatic bath, a mixture solvent of 180 parts by mass of ethyl acetate and 80 parts by mass of isopropyl alcohol is input to the reaction vessel, 300 parts by mass of the amorphous polyester resin (PES-A1) is input thereto, and the resultant is stirred and dissolved at 150 rpm by the use of a three-one motor, whereby an oil phase is obtained. A mixture solution of 1 part by mass of a 10% by mass ammonia solution and 47 parts by mass of a 5% by mass sodium hydroxide solution is dropped to the oil phase under stirring for 5 minutes, the mixture is mixed for 10 minutes, and 900 parts by mass of ion-exchange water is dropped thereto at a rate of 5 parts by mass per minute to change the phase, whereby an emulsified liquid is obtained.

Immediately, 800 parts by mass of the obtained emulsified liquid and 700 parts by mass of ion-exchange water are input to a 2-L recovery flask and the recovery flask is set in an evaporator (made by Tokyo Rikakikai Co., LTD.) equipping with a vacuum control unit via a spherical trap. The recovery flask is heated in a hot water bath of 60° C. while rotating and is depressurized to 7 kPa to remove the solvent while watching the bumping. When the amount of solvent collected reaches 1100 parts by mass, and the pressure is returned to a normal pressure and the recovery flask is cooled with water, whereby a dispersion is obtained. There is no solvent odor in the obtained dispersion. The volume-average particle diameter D50v of the resin particles in the dispersion is 150 nm. Thereafter, an anionic surfactant (DowFax 2A1, made by Dow Chemical Co., with an effective content of 45% by mass) is mixed therewith by 2% by mass as an effective component with respect to the resin content in the dispersion, ion-exchange water is added thereto to adjust the solid concentration to 20% by mass. The obtained dispersion is used as an amorphous polyester resin particle dispersion (DA-A1).

Preparation of Amorphous Polyester Resin Particle Dispersion (DA-A2)

An amorphous polyester resin particle dispersion (DA-A2) is obtained in the same way as preparing the amorphous polyester resin particle dispersion (DA-A1), except that the amorphous polyester resin (PES-A1) is replaced with the amorphous polyester resin (PES-A2). The volume-average particle diameter D50v of resin particles in the dispersion is 110 nm.

Example 1

Preparation of Added Amorphous Polyester Resin Particle Dispersion (DA-A1A)

Amorphous polyester resin particle dispersion (DA-A1): 160 parts by mass

Amorphous polyester resin particle dispersion (DA-A2): 160 parts by mass

The materials are input to a 500 ml beaker and are stirred at a rate not generating bubbles by the use of a magnetic stirrer, and pH is adjusted to 4.0 using a 1.0% by mass acetic acid solution, whereby an added amorphous polyester resin particle dispersion (DA-A1A) is obtained.

Preparation of Aluminum Sulfate Solution (SA1A)

Aluminum sulfate powder (17% aluminum sulfate, made by Asada Chemical Industry Co., Ltd.): 1.2 parts by mass Ion-exchange water: 20 parts by mass The materials are input to a 30 ml vessel and are stirred and mixed at 30° C. until the precipitates disappear, whereby an aluminum sulfate solution (SA1A) is prepared.

Preparation of Toner (TNA1A)

Amorphous polyester resin particle dispersion (DA-A1): 380 parts by mass

Amorphous polyester resin particle dispersion (DA-A2): 380 parts by mass

Release agent dispersion (DW1): 130 parts by mass

Colorant dispersion (PDK1): 100 parts by mass

Ion-exchange water: 650 parts by mass

The materials are input to a 3-L reaction vessel equipping with a thermometer, a pH meter, and a stirrer, a 1.0% by mass acetic acid is added thereto at a temperature of 25° C. to adjust pH to 4.0 while stirring the material to such an extent not to generate a vortex, the prepared aluminum sulfate solution (SA1A) is totally added thereto while dispersing the product at 5000 rpm by the use of a homogenizer (Ultratracks T50, made by IKA Japan), and the product is dispersed for 6 minutes.

Thereafter, a mantel heater is installed in the reaction vessel, the number of rotations of the stirrer is adjusted to maintain a state where slurry is sufficiently stirred, the temperature is raised at a temperature rising rate of 0.2° C./min before 40° C., at a temperature rising rate of 0.1° C./min after 40° C., and at a temperature rising rate of 0.02° C./min after 45° C., and the particle diameter is measured by the use of Multisizer every 10 minutes. When the volume-average particle diameter is 5.0 μm, all the added amorphous polyester resin particle dispersion (DA-A1A) is input thereto for 60 minutes.

After inputting the added amorphous polyester resin particle dispersion (DA-A1A), 3 parts by mass of EDTA (Chelst 40, made by Chelest Corporation, with an effective content of 40% by mass) and 1.3 parts by mass of methylglycine diacetate (Trilon M, made by BASF Corporation, with an effective content of 40% by mass) are added thereto for 5 minutes, and pH is adjusted to 9.0 by the use of a 1% by mass sodium hydroxide solution.

Thereafter, the temperature is raised at a temperature rising rate of 1° C./min to 95° C. while adjusting the pH to 9.0 by the use of the 1% by mass sodium hydroxide solution every 5° C., and the temperature is held at 95° C. After reaching 95° C., the pH is, lowered by 0.05 every 10 minutes by the use of a 1.0% by mass acetic acid solution, the shape factor is measured by the use of FPIA-3000 (made by Sysmex Corporation), and the vessel is cooled to 30° C. with a coolant for 5 minutes when the average shape factor is 0.964.

The cooled slurry is made to pass through a nylon mesh with apertures of 20 μm to remove coarse particles, an acetic acid is added to the toner slurry passing through the mesh to adjust the pH to 6.0, and the toner slurry is depressurized and filtrated with an aspirator and is separated into solid and liquid. The toner remaining in the filter paper is pulverized, the toner is input to ion-exchange water of 10 times the amount of toner at a temperature of 30° C., the mixture is stirred and mixed for 30 minutes, and the mixture is separated into solid and liquid again by the use of an aspirator. This operation is repeated until the conductivity of the filtrate is equal to or less than 10 μS/cm, and the toner is washed.

The washed toner is finely pulverized by the use of a wet and dry granulator (Comil), and the toner is dried in vacuum in an oven of 35° C. for 36 hours, whereby toner particles are obtained. 1.0 parts by mass of hydrophobic silica (RY50, made by Nippon Aerosil Co., Ltd.) is added to 100 parts by mass of the obtained toner particles and the mixture is mixed at 13000 rpm for 30 seconds by the use of a sample mill. Thereafter, the mixture is sieved by the use of a vibrating sieve with apertures of 45 μm, whereby a toner (TNA1A) is obtained.

The obtained toner (TNA1A) has a volume-average particle diameter D50v of 6.0 μm and a shape factor SF1 of 0.965. As a result of observation of an SEM image of the toner, the surface of the toner is smooth and a problem with protrusion of the release agent, peeling of the surface layer, or the like does not occur.

Preparation of Resin-coated Carrier (C)

Mn—Mg—Sr ferrite particles (with an average particle diameter of 40 μm): 100 parts by mass Toluene: 14 parts by mass Cyclohexyl methacrylate/dimethylaminoethyl methacrylate copolymer (with a copolymerization weight ratio of 99:1 and Mw of 80000): 2.0 parts by mass Carbon black (VXC72, made by Cabot Corporation): 0.12 parts by mass The components other than the ferrite particles and glass beads (with ϕ1 mm and with the same amount of toluene) are stirred at 1200 rpm for 30 minutes by the use of a sand mill made by Kansai Paint Co., Ltd., whereby a resin coating layer forming solution is obtained. The resin coating layer forming solution and the ferrite particles are input to a vacuum deaeration kneader, the kneader is depressurized, toluene is distilled away, and the resultant is dried, whereby a resin-coated carrier (C) is prepared.

Preparation of Developer (DTNA1A)

40 parts by mass of the toner (TNA1A) is added to 500 parts by mass of the resin-coated carrier (C), the mixture is mixed for 20 minutes by the use of a V-shaped mixer, and aggregates are removed by the use of a vibrating sieve with apertures of 212 μm, whereby a developer (DTNA1A) is prepared.

Example 2

Preparation of Added Amorphous Polyester Resin Particle Dispersion (DA-A2A)

Amorphous polyester resin particle dispersion (DA-A1): 160 parts by mass

Amorphous polyester resin particle dispersion (DA-A2): 160 parts by mass

The materials are input to a 500 ml beaker and are stirred at a rate not generating bubbles by the use of a magnetic stirrer, and pH is adjusted to 4.0 using a 1.0% by mass acetic acid solution, whereby an added amorphous polyester resin particle dispersion (DA-A2A) is obtained.

Preparation of Aluminum Sulfate Solution (SA2A)

Aluminum sulfate powder (17% aluminum sulfate, made by Asada Chemical Industry Co., Ltd.): 1.2 parts by mass Ion-exchange water: 20 parts by mass The materials are input to a 30 ml vessel and are stirred and mixed at 30° C. until the precipitates disappear, whereby an aluminum sulfate solution (SA2A) is prepared.

Preparation of Toner (TNA2A)

Amorphous polyester resin particle dispersion (DA-A1): 380 parts by mass

Amorphous polyester resin particle dispersion (DA-A2): 380 parts by mass

Release agent dispersion (DW1): 130 parts by mass

Colorant dispersion (PDK1): 100 parts by mass

Ion-exchange water: 650 parts by mass

The materials are input to a 3-L reaction vessel equipping with a thermometer, a pH meter, and a stirrer, a 1.0% by mass acetic acid is added thereto at a temperature of 25° C. to adjust pH to 4.0 while stirring the mixture to such an extent not to generate a vortex, the prepared aluminum sulfate solution (SA2A) is totally added thereto while dispersing the mixture at 5000 rpm by the use of a homogenizer (Ultratracks T50, made by IKA Japan), and the mixture is dispersed for 6 minutes.

Thereafter, a mantel heater is installed in the reaction vessel, the number of rotations of the stirrer is adjusted to maintain a state where slurry is sufficiently stirred, the temperature is raised at a temperature rising rate of 0.2° C./min before 40° C., at a temperature rising rate of 0.1° C./min after 40° C., and at a temperature rising rate of 0.02° C./min. after 45° C., and the particle diameter is measured by the use of Multisizer every 10 minutes. When the volume-average particle diameter is 5.0 μm, all the added amorphous polyester resin particle dispersion (DA-A2A) is input thereto for 30 minutes.

After inputting the added amorphous polyester resin particle dispersion (DA-A2A), the resultant is stirred and mixed for 30 minutes, 12.5 parts by mass of methylglycine diacetate (Trilon M, made by BASF Corporation, with an effective content of 40% by mass) is added thereto for 5 minutes, and pH is adjusted to 9.2 by the use of a 1% by mass sodium hydroxide solution.

Thereafter, the temperature is raised at a temperature rising rate of 1° C./min to 95° C. while adjusting the pH to 9.0 by the use of the 1% by mass sodium hydroxide solution every 5° C., and the temperature is held at 95° C. After reaching 95° C., the pH is lowered by 0.05 every 10 minutes by the use of a 1.0% by mass acetic acid solution, the shape factor is measured by the use of FPIA-3000 (made by Sysmex Corporation), and the vessel is cooled to 30° C. with a coolant for 5 minutes when the average shape factor is 0.964.

The cooled slurry is made to pass through a nylon mesh with apertures of 20 μm to remove coarse particles and the toner slurry passing through the mesh is depressurized and filtrated with an aspirator and is separated into solid and liquid. The toner remaining in the filter paper is pulverized, the resultant is input to ion-exchange water of 10 times the amount of toner at a temperature of 30° C., the resultant is stirred and mixed for 30 minutes, and the resultant is separated into solid and liquid again by the use of an aspirator. This operation is repeated until the conductivity of the filtrate is equal to or less than 10 μS/cm, and the toner is washed.

The washed toner is finely pulverized by the use of a wet and dry granulator (Comil), and the resultant is dried in vacuum in an oven of 35° C. for 36 hours, whereby toner particles are obtained. 1.0 parts by mass of hydrophobic silica (RY50, made by Nippon Aerosil Co., Ltd.) is added to 100 parts by mass of the obtained toner particles and the resultant is mixed at 13000 rpm for 30 seconds by the use of a sample mill. Thereafter, the mixture is sieved by the use of a vibrating sieve with apertures of 45 μm, whereby a toner (TNA2A) is obtained.

The obtained toner (TNA2A) has a volume-average particle diameter D50v of 6.1 μm and a shape factor SF1 of 0.967. As a result of observation of an SEM image of the toner, the surface of the toner is smooth and a problem with protrusion of the release agent, peeling of the surface layer, or the like does not occur.

Preparation of Developer (DTNA2A)

40 parts by mass of the toner (TNA2A) is added to 500 parts by mass of the resin-coated carrier (C), the resultant is mixed for 20 minutes by the use of a V-shaped mixer, and aggregates are removed by the use of a vibrating sieve with apertures of 212 μm, whereby a developer (DTNA2A) is prepared.

Example 3

Preparation of Added Amorphous Polyester Resin Particle Dispersion (DA-A3A)

Amorphous polyester resin particle dispersion (DA-A1): 160 parts by mass

Amorphous polyester resin particle dispersion (DA-A2): 160 parts by mass

The materials are input to a 500 ml beaker and are stirred at a rate not generating bubbles by the use of a magnetic stirrer, and pH is adjusted to 4.0 using a 1.0% by mass acetic acid solution, whereby an added amorphous polyester resin particle dispersion (DA-A3A) is obtained.

Preparation of Aluminum Sulfate Solution (SA3A)

Aluminum sulfate powder (17% aluminum sulfate, made by Asada Chemical Industry Co., Ltd.): 1.6 parts by mass Ion-exchange water: 20 parts by mass The materials are input to a 30 ml vessel and are stirred and mixed at 30° C. until the precipitates disappear, whereby an aluminum sulfate solution (SA3A) is prepared.

Preparation of Toner (TNA3A)

Amorphous polyester resin particle dispersion (DA-A1): 380 parts by mass

Amorphous polyester resin particle dispersion (DA-A2): 380 parts by mass

Release agent dispersion (DW1): 130 parts by mass

Colorant dispersion (PDK1): 100 parts by mass

Ion-exchange water: 650 parts by mass

The materials are input to a 3-L reaction vessel equipping with a thermometer, a pH meter, and a stirrer, a 1.0% by mass acetic acid is added thereto at a temperature of 25° C. to adjust pH to 4.0 while stirring the resultant to such an extent not to generate a vortex, the prepared aluminum sulfate solution (SA3A) is totally added thereto while dispersing the resultant at 5000 rpm by the use of a homogenizer (Ultratracks T50, made by IKA Japan), and the resultant is dispersed for 6 minutes.

Thereafter, a mantel heater is installed in the reaction vessel, the number of rotations of the stirrer is adjusted to maintain a state where slurry is sufficiently stirred, the temperature is raised at a temperature rising rate of 0.2° C./min before 40° C., at a temperature rising rate of 0.1° C./min after 40° C., and at a temperature rising rate of 0.02° C./min after 45° C., and the particle diameter is measured by the use of Multisizer every 10 minutes. When the volume-average particle diameter is 5.0 μm, all the added amorphous polyester resin particle dispersion (DA-A3A) is input thereto for 30 minutes.

After inputting the added amorphous polyester resin particle dispersion (DA-A3A), the resultant is stirred and mixed for 30 minutes, 1.3 parts by mass of EDTA (Chelest 40, made by Chelest Corporation, with an effective content of 40% by mass) and 1.1 parts by mass of methylglycine diacetate (Trilon M, made by BASF Corporation, with an effective content of 40% by mass) are added thereto for 5 minutes, and 100 parts by mass of a 1% by mass sodium hydroxide solution is added thereto.

Thereafter, the temperature is raised at a temperature rising rate of 1° C./min to 95° C. while adding 5 parts by mass of the 1% by mass sodium hydroxide solution every 5° C., and the temperature is held at 95° C. After reaching 95° C., the pH is lowered by 0.05 every 10 minutes by the use of a 1.0% by mass acetic acid solution, the shape factor is measured by the use of FPIA-3000 (made by Sysmex Corporation), and the vessel is cooled to 30° C. with a coolant for 5 minutes when the average shape factor is 0.964.

The cooled slurry is made to pass through a nylon mesh with apertures of 20 μm to remove coarse particles, an acetic acid is added to the toner slurry passing through the mesh to adjust the pH to 6.0, and the toner slurry is depressurized and filtrated with an aspirator and is separated into solid and liquid. The toner remaining in the filter paper is pulverized, the resultant is input to ion-exchange water of 10 times the amount of toner at a temperature of 30° C., the resultant is stirred and mixed for 30 minutes, and the resultant is separated into solid and liquid again by the use of an aspirator. This operation is repeated until the conductivity of the filtrate is equal to or less than 10 μS/cm, and the toner is washed.

The washed toner is finely pulverized by the use of a wet and dry granulator (Comil), and the resultant is dried in vacuum in an oven of 35° C. for 36 hours, whereby toner particles are obtained. 1.0 parts by mass of hydrophobic silica (RY50, made by Nippon Aerosil Co., Ltd.) is added to 100 parts by mass of the obtained toner particles and the resultant is mixed at 13000 rpm for 30 seconds by the use of a sample mill. Thereafter, the resultant is sieved by the use of a vibrating sieve with apertures of 45 μm, whereby a toner (TNA3A) is obtained.

The obtained toner (TNA3A) has a volume-average particle diameter D50v of 6.3 μm and a shape factor SF1 of 0.965. As a result of observation of an SEM image of the toner, the surface of the toner is smooth and a problem with protrusion of the release agent, peeling of the surface layer, or the like does not occur.

Preparation of Developer (DTNA3A)

40 parts by mass of the toner (TNA3A) is added to 500 parts by mass of the resin-coated carrier (C), the resultant is mixed for 20 minutes by the use of a V-shaped mixer, and aggregates are removed by the use of a vibrating sieve with apertures of 212 μm, whereby a developer (DTNA3A) is prepared.

Example 4

Preparation of Added Amorphous Polyester Resin Particle Dispersion (DA-A4A)

Amorphous polyester resin particle dispersion (DA-A1): 160 parts by mass

Amorphous polyester resin particle dispersion (DA-A2): 160 parts by mass

The materials are input to a 500 ml beaker and are stirred at a rate not generating bubbles by the use of a magnetic stirrer, and pH is adjusted to 4.0 using a 1.0% by mass acetic acid solution, whereby an added amorphous polyester resin particle dispersion (DA-A4A) is obtained.

Preparation of Aluminum Sulfate Solution (SA4A)

Aluminum sulfate powder (17% aluminum sulfate, made by Asada Chemical Industry Co., Ltd.): 1.6 parts by mass Ion-exchange water: 20 parts by mass The materials are input to a 30 ml vessel and are stirred and mixed at 30° C. until the precipitates disappear, whereby an aluminum sulfate solution (SA4A) is prepared.

Preparation of Toner (TNA4A)

Amorphous polyester resin particle dispersion (DA-A1): 380 parts by mass

Amorphous polyester resin particle dispersion (DA-A2): 380 parts by mass

Release agent dispersion (DW1): 130 parts by mass

Colorant dispersion (PDK1): 100 parts by mass

Ion-exchange water: 650 parts by mass

The materials are input to a 3-L reaction vessel equipping with a thermometer, a pH meter, and a stirrer, a 1.0% by mass acetic acid is added thereto at a temperature of 25° C. to adjust pH to 4.0 while stirring the resultant to such an extent not to generate a vortex, the prepared aluminum sulfate solution (SA4A) is totally added thereto while dispersing the resultant at 5000 rpm by the use of a homogenizer (Ultratracks T50, made by IKA Japan), and the resultant is dispersed for 6 minutes.

Thereafter, a mantel heater is installed in the reaction vessel, the number of rotations of the stirrer is adjusted to maintain a state where slurry is sufficiently stirred, the temperature is raised at a temperature rising rate of 0.2° C./min before 40° C., at a temperature rising rate of 0.1° C./min after 40° C., and at a temperature rising rate of 0.02° C./min after 45° C., and the particle diameter is measured by the use of Multisizer every 10 minutes. When the volume-average particle diameter is 5.0 μm, all the added amorphous polyester resin particle dispersion (DA-A4A) is input thereto for 30 minutes.

After inputting the added amorphous polyester resin particle dispersion (DA-A4A), the resultant is stirred and mixed for 30 minutes, 12.0 parts by mass of methylglycine diacetate (Trilon M, made by BASF Corporation, with an effective content of 40% by mass) are added thereto for 5 minutes, and 100 parts by mass of a 1% by mass sodium hydroxide solution is added thereto.

Thereafter, the temperature is raised at a temperature rising rate of 1° C./min to 95° C. while adding 3 parts by mass of the 1% by mass sodium hydroxide solution every 5° C., and the temperature is held at 95° C. After reaching 95° C., the pH is lowered by 0.05 every 10 minutes by the use of a 1.0% by mass acetic acid solution, the shape factor is measured by the use of FPIA-3000 (made by Sysmex Corporation), and the vessel is cooled to 30° C. with a coolant for 5 minutes when the average shape factor is 0.964.

The cooled slurry is made to pass through a nylon mesh with apertures of 20 μm to remove coarse particles, and the toner slurry passing through the mesh is depressurized and filtrated with an aspirator and is separated into solid and liquid. The toner remaining in the filter paper is pulverized, the resultant is input to ion-exchange water of 10 times the amount of toner at a temperature of 30° C., the resultant is stirred and mixed for 30 minutes, and the resultant is separated into solid and liquid again by the use of an aspirator. This operation is repeated until the conductivity of the filtrate is equal to or less than 10 μS/cm, and the toner is washed.

The washed toner is finely pulverized by the use of a wet and dry granulator (Comil), and the resultant is dried in vacuum in an oven of 35° C. for 36 hours, whereby toner particles are obtained. 1.0 parts by mass of hydrophobic silica (RY50, made by Nippon Aerosil Co., Ltd.) is added to 100 parts by mass of the obtained toner particles and the resultant is mixed at 13000 rpm for 30 seconds by the use of a sample mill. Thereafter, the resultant is sieved by the use of a vibrating sieve with apertures of 45 μm, whereby a toner (TNA4A) is obtained.

The obtained toner (TNA4A) has a volume-average particle diameter D50v of 6.3 μm and a shape factor SF1 of 0.965. As a result of observation of an SEM image of the toner, the surface of the toner is smooth and a problem with protrusion of the release agent, peeling of the surface layer, or the like does not occur.

Preparation of Developer (DTNA4A)

40 parts by mass of the toner (TNA4A) is added to 500 parts by mass of the resin-coated carrier (C), the resultant is mixed for 20 minutes by the use of a V-shaped mixer, and aggregates are removed by the use of a vibrating sieve with apertures of 212 μm, whereby a developer (DTNA4A) is prepared.

Example 5

Preparation of Added Amorphous Polyester Resin Particle Dispersion (DA-A5A)

Amorphous polyester resin particle dispersion (DA-A1): 160 parts by mass

Amorphous polyester resin particle dispersion (DA-A2): 160 parts by mass

The materials are input to a 500 ml beaker and are stirred at a rate not generating bubbles by the use of a magnetic stirrer, and pH is adjusted to 4.0 using a 1.0% by mass acetic acid solution, whereby an added amorphous polyester resin particle dispersion (DA-A5A) is obtained.

Preparation of Aluminum Sulfate Solution (SA5A)

Aluminum sulfate powder (17% aluminum sulfate, made by Asada Chemical Industry Co., Ltd.): 1.4 parts by mass Ion-exchange water: 20 parts by mass The materials are input to a 30 ml vessel and are stirred and mixed at 30° C. until the precipitates disappear, whereby an aluminum sulfate solution (SA5A) is prepared.

Preparation of Toner (TNA5A)

Amorphous polyester resin particle dispersion (DA-A1): 380 parts by mass

Amorphous polyester resin particle dispersion (DA-A2): 380 parts by mass

Release agent dispersion (DW1): 130 parts by mass

Colorant dispersion (PDK1): 100 parts by mass

Ion-exchange water: 650 parts by mass

The materials are input to a 3-L reaction vessel equipping with a thermometer, a pH meter, and a stirrer, a 1.0% by mass acetic acid is added thereto at a temperature of 25° C. to adjust pH to 4.0 while stirring the resultant to such an extent not to generate a vortex, the prepared aluminum sulfate solution (SA5A) is totally added thereto while dispersing the resultant at 5000 rpm by the use of a homogenizer (Ultratracks T50, made by IKA Japan), and the resultant is dispersed for 6 minutes.

Thereafter, a mantel heater is installed in the reaction vessel, the number of rotations of the stirrer is adjusted to maintain a state where slurry is sufficiently stirred, the temperature is raised at a temperature rising rate of 0.2° C./min before 40° C., at a temperature rising rate of 0.1° C./min after 40° C., and at a temperature rising rate of 0.02° C./min after 45° C., and the particle diameter is measured by the use of Multisizer every 10 minutes. When the volume-average particle diameter is 5.0 μm, all the added amorphous polyester resin particle dispersion (DA-A5A) is input thereto for 30 minutes.

After inputting the added amorphous polyester resin particle dispersion (DA-A5A), the resultant is stirred and mixed for 30 minutes, 9.0 parts by mass of methylglycine diacetate (Trilon M, made by BASF Corporation, with an effective content of 40% by mass) are added thereto for 5 minutes, and 120 parts by mass of a 1% by mass sodium hydroxide solution is added thereto.

Thereafter, the temperature is raised at a temperature rising rate of 1° C./min to 95° C. while adding 4 parts by mass of the 1% by mass sodium hydroxide solution every 5° C., and the temperature is held at 95° C. After reaching 95° C., the pH is lowered by 0.05 every 10 minutes by the use of a 1.0% by mass acetic acid solution, the shape factor is measured by the use of FPIA-3000 (made by Sysmex Corporation), and the vessel is cooled to 30° C. with a coolant for 5 minutes when the average shape factor is 0.964.

The cooled slurry is made to pass through a nylon mesh with apertures of 20 μm to remove coarse particles, and the toner slurry passing through the mesh is depressurized and filtrated with an aspirator and is separated into solid and liquid. The toner remaining in the filter paper is pulverized, the resultant is input to ion-exchange water of 10 times the amount of toner at a temperature of 30° C., the resultant is stirred and mixed for 30 minutes, and the resultant is separated into solid and liquid again by the use of an aspirator. This operation is repeated until the conductivity of the filtrate is equal to or less than 10 μS/cm, and the toner is washed.

The washed toner is finely pulverized by the use of a wet and dry granulator (Comil), and the resultant is dried in vacuum in an oven of 35° C. for 36 hours, whereby toner particles are obtained. 1.0 parts by mass of hydrophobic silica (RY50, made by Nippon Aerosil Co., Ltd.) is added to 100 parts by mass of the obtained toner particles and the resultant is mixed at 13000 rpm for 30 seconds by the use of a sample mill. Thereafter, the resultant is sieved by the use of a vibrating sieve with apertures of 45 μm, whereby a toner (TNA5A) is obtained.

The obtained toner (TNA5A) has a volume-average particle diameter D50v of 6.3 μm and a shape factor SF1 of 0.965. As a result of observation of an SEM image of the toner, the surface of the toner is smooth and a problem with protrusion of the release agent, peeling of the surface layer, or the like does not occur.

Preparation of Developer (DTNA5A)

40 parts by mass of the toner (TNA5A) is added to 500 parts by mass of the resin-coated carrier (C), the resultant is mixed for 20 minutes by the use of a V-shaped mixer, and aggregates are removed by the use of a vibrating sieve with apertures of 212 whereby a developer (DTNA5A) is prepared.

Example 6

Preparation of Amorphous Polyester Resin Particle Dispersion (DA-A61)

A jacketed 3-liter reaction vessel (BJ-30N, made by Tokyo Rikakikai Co., LTD.) equipping with a condenser, a thermometer, a water dropping device, and an anchor blade is held at 40° C. by the use of a water-circulation thermostatic bath, a mixture solvent of 180 parts by mass of ethyl acetate and 80 parts by mass of isopropyl alcohol is input to the reaction vessel, 300 parts by mass of the amorphous polyester resin (PES-A1) is input thereto, and the resultant is stirred and dissolved at 150 rpm by the use of a three-one motor, whereby an oil phase is obtained. A mixture solution of 8 parts by mass of a 10% by mass ammonia solution and 15 parts by mass of a 5% by mass sodium hydroxide solution is dropped to the oil phase under stirring for 5 minutes, the resultant is mixed for 10 minutes, and 900 parts by mass of ion-exchange water is dropped thereto at a rate of 5 parts by mass per minute to change the phase, whereby an emulsified liquid is obtained.

Immediately, 800 parts by mass of the obtained emulsified liquid and 700 parts by mass of ion-exchange water are input to a 2-L recovery flask and the recovery flask is set in an evaporator (made by Tokyo Rikakikai Co., LTD.) equipping with a vacuum control unit via a spherical trap. The recovery flask is heated in a water bath of 60° C. while rotating and is depressurized to 7 kPa to remove the solvent while watching the bumping. When the amount of solvent collected reaches 1100 parts by mass, and the pressure is returned to a normal pressure and the recovery flask is cooled with water, whereby a dispersion is obtained. There is no solvent odor in the obtained dispersion. The volume-average particle diameter D50v of the resin particles in the dispersion is 140 nm. Thereafter, an anionic surfactant (DowFax 2A1, made by Dow Chemical Co., with an effective content of 45% by mass) is mixed therewith by 2% by mass as an effective component with respect to the resin content in the dispersion, ion-exchange water is added thereto to adjust the solid concentration to 20% by mass. The resultant is used as an amorphous polyester resin particle dispersion (DA-A61).

Preparation of Amorphous Polyester Resin Particle Dispersion (DA-A62)

An amorphous polyester resin particle dispersion (DA-A62) is obtained in the same way as preparing the amorphous polyester resin particle dispersion (DA-A61), except that the amorphous polyester resin (PES-A1) is replaced with the amorphous polyester resin (PES-A2). The volume-average particle diameter D50v of resin particles in the amorphous polyester resin particle dispersion (DA-A62) is 100 nm.

Preparation of Added Amorphous Polyester Resin Particle Dispersion (DA-A6A)

- Amorphous polyester resin particle dispersion (DA-A61): 160 parts by mass
- Amorphous polyester resin particle dispersion (DA-A62): 160 parts by mass The materials are input to a 500 ml beaker and are stirred at a rate not generating bubbles by the use of a magnetic stirrer, and pH is adjusted to 4.0 using a 1.0% by mass acetic acid solution, whereby an added amorphous polyester resin particle dispersion (DA-A6A) is obtained.

Preparation of Aluminum Sulfate Solution (SAGA)

- Aluminum sulfate powder (17% aluminum sulfate, made by Asada Chemical Industry Co., Ltd.): 1.2 parts by mass
- Ion-exchange water: 20 parts by mass The materials are input to a 30 ml vessel and are stirred and mixed at 30° C. until the precipitates disappear, whereby an aluminum sulfate solution (SA6A) is prepared.

Preparation of Toner (TNA6A)

- Amorphous polyester resin particle dispersion (DA-A61): 380 parts by mass
- Amorphous polyester resin particle dispersion (DA-A62): 380 parts by mass
- Release agent dispersion (DW1): 130 parts by mass
- Colorant dispersion (PDK1): 100 parts by mass
- Ion-exchange water: 650 parts by mass The materials are input to a 3-L reaction vessel equipping with a thermometer, a pH meter, and a stirrer, a 1.0% by mass acetic acid is added thereto at a temperature of 25° C. to adjust pH to 4.0 while stirring the resultant to such an extent not to generate a vortex, the prepared aluminum sulfate solution (SA6A) is totally added thereto while dispersing the resultant at 5000 rpm by the use of a homogenizer (Ultratracks T50, made by IKA Japan), and the resultant is dispersed for 6 minutes.

Thereafter, a mantel heater is installed in the reaction vessel, the number of rotations of the stirrer is adjusted to maintain a state where slurry is sufficiently stirred, the temperature is raised at a temperature rising rate of 0.2° C./min before 40° C., at a temperature rising rate of 0.1° C./min after 40° C., and at a temperature rising rate of 0.02° C./min after 45° C., and the particle diameter is measured by the use of Multisizer every 10 minutes. When the volume-average particle diameter is 5.0 μm, all the added amorphous polyester resin particle dispersion (DA-A6A) is input thereto for 60 minutes.

After inputting the added amorphous polyester resin particle dispersion (DA-A6A), the resultant is stirred and mixed for 30 minutes, 9.0 parts by mass of methylglycine diacetate (Trilon M, made by BASF Corporation, with an effective content of 40% by mass) are added thereto for 5 minutes, and 120 parts by mass of a 1% by mass sodium hydroxide solution is added thereto.

Thereafter, the temperature is raised at a temperature rising rate of 1° C./min to 95° C. while adding 4 parts by mass of the 1% by mass sodium hydroxide solution every 5° C., and the temperature is held at 95° C. After reaching 95° C., the pH is lowered by 0.05 every 10 minutes by the use of a 1.0% by mass acetic acid solution, the shape factor is measured by the use of FPIA-3000 (made by Sysmex Corporation), and the vessel is cooled to 30° C. with a coolant for 5 minutes when the average shape factor is 0.964.

The cooled slurry is made to pass through a nylon mesh with apertures of 20 μm to remove coarse particles, and the toner slurry passing through the mesh is depressurized and filtrated with an aspirator and is separated into solid and liquid. The toner remaining in the filter paper is pulverized, the resultant is input to ion-exchange water of 10 times the amount of toner at a temperature of 30° C., the resultant is stirred and mixed for 30 minutes, and the resultant is separated into solid and liquid again by the use of an aspirator. This operation is repeated until the conductivity of the filtrate is equal to or less than 10 μS/cm, and the toner is washed.

The washed toner is finely pulverized by the use of a wet and dry granulator (Comil), and the resultant is dried in vacuum in an oven of 35° C. for 36 hours, whereby toner particles are obtained. 1.0 parts by mass of hydrophobic silica (RY50, made by Nippon Aerosil Co., Ltd.) is added to 100 parts by mass of the obtained toner particles and the resultant is mixed at 13000 rpm for 30 seconds by the use of a sample mill. Thereafter, the resultant is sieved by the use of a vibrating sieve with apertures of 45 μm, whereby a toner (TNA6A) is obtained.

The obtained toner (TNA6A) has a volume-average particle diameter D50v of 6.0 μm and a shape factor SF1 of 0.965. As a result of observation of an SEM image of the toner, the surface of the toner is smooth and a problem with protrusion of the release agent, peeling of the surface layer, or the like does not occur.

Preparation of Developer (DTNA6A)

40 parts by mass of the toner (TNA6A) is added to 500 parts by mass of the resin-coated carrier (C), the resultant is mixed for 20 minutes by the use of a V-shaped mixer, and aggregates are removed by the use of a vibrating sieve with apertures of 212 μm, whereby a developer (DTNA6A) is prepared.

Example 7

Preparation of Amorphous Polyester Resin Particle Dispersion (DA-A71)

A jacketed 3-liter reaction vessel (BJ-30N, made by Tokyo Rikakikai Co., LTD.) equipping with a condenser, a thermometer, a water dropping device, and an anchor blade is held at 40° C. by the use of a water-circulation thermostatic bath, a mixture solvent of 180 parts by mass of ethyl acetate and 80 parts by mass of isopropyl alcohol is input to the reaction vessel, 300 parts by mass of the amorphous polyester resin (PES-A1) is input thereto, and the resultant is stirred and dissolved at 150 rpm by the use of a three-one motor, whereby an oil phase is obtained. 15 parts by mass of a 10% by mass ammonia solution is dropped to the oil phase under stirring for 5 minutes, the resultant is mixed for 10 minutes, and 900 parts by mass of ion-exchange water is dropped thereto at a rate of 5 parts by mass per minute to change the phase, whereby an emulsified liquid is obtained.

Immediately, 800 parts by mass of the obtained emulsified liquid and 700 parts by mass of ion-exchange water are input to a 2-L recovery flask and the recovery flask is set in an evaporator (made by Tokyo Rikakikai Co., LTD.) including a vacuum control unit via a spherical trap. The recovery flask is heated in a water bath of 60° C. while rotating and is depressurized to 7 kPa to remove the solvent while watching the bumping. When the amount of solvent collected reaches 1000 parts by mass, and the pressure is returned to a normal pressure and the recovery flask is cooled with water, whereby a dispersion is obtained. There is no solvent odor in the obtained dispersion. The volume-average particle diameter D50v of the resin particles in the dispersion is 130 nm. Thereafter, an anionic surfactant (DowFax 2A1, made by Dow Chemical Co., with an effective content of 45% by mass) is mixed therewith by 2% by mass as an effective component with respect to the resin content in the dispersion, ion-exchange water is added thereto to adjust the solid concentration to 20% by mass. The resultant is used as an amorphous polyester resin particle dispersion (DA-A71).

Preparation of Amorphous Polyester Resin Particle Dispersion (DA-A72)

An amorphous polyester resin particle dispersion (DA-A72) is obtained in the same way as preparing the amorphous polyester resin particle dispersion (DA-A71), except that the amorphous polyester resin (PES-A1) is replaced with the amorphous polyester resin (PES-A2). The volume-average particle diameter D50v of resin particles in the amorphous polyester resin particle dispersion (DA-A72) is 100 nm.

Preparation of Added Amorphous Polyester Resin Particle Dispersion (DA-A7A)

Amorphous polyester resin particle dispersion (DA-A71): 160 parts by mass

Amorphous polyester resin particle dispersion (DA-A72): 160 parts by mass

The materials are input to a 500 ml beaker and are stirred at a rate not generating bubbles by the use of a magnetic stirrer, and pH is adjusted to 4.0 using a 1.0% by mass acetic acid solution, whereby an added amorphous polyester resin particle dispersion (DA-A7A) is obtained.

Preparation of Aluminum Sulfate Solution (SA7A)

Aluminum sulfate powder (17% aluminum sulfate, made by Asada Chemical Industry Co., Ltd.): 1.2 parts by mass Ion-exchange water: 20 parts by mass The materials are input to a 30 ml vessel and are stirred and mixed at 30° C. until the precipitates disappear, whereby an aluminum sulfate solution (SA7A) is prepared.

Preparation of Toner (TNA7A)

Amorphous polyester resin particle dispersion (DA-A71): 380 parts by mass

Amorphous polyester resin particle dispersion (DA-A72): 380 parts by mass

Release agent dispersion (DW1): 130 parts by mass

Colorant dispersion (PDK1): 100 parts by mass

Ion-exchange water: 650 parts by mass

The materials are input to a 3-L reaction vessel equipping with a thermometer, a pH meter, and a stirrer, a 1.0% by mass acetic acid is added thereto at a temperature of 25° C. to adjust pH to 4.0 while stirring the resultant to such an extent not to generate a vortex, the prepared aluminum sulfate solution (SA7A) is totally added thereto while dispersing the resultant at 5000 rpm by the use of a homogenizer (Ultratracks T50, made by IKA Japan), and the resultant is dispersed for 6 minutes.

Thereafter, a mantel heater is installed in the reaction vessel, the number of rotations of the stirrer is adjusted to maintain a state where slurry is sufficiently stirred, the temperature is raised at a temperature rising rate of 0.2° C./min before 40° C., at a temperature rising rate of 0.1° C./min after 40° C., and at a temperature rising rate of 0.02° C./min after 45° C., and the particle diameter is measured by the use of Multisizer every 10 minutes. When the volume-average particle diameter is 5.0 μm, all the added amorphous polyester resin particle dispersion (DA-A7A) is input thereto for 60 minutes.

After inputting the added amorphous polyester resin particle dispersion (DA-A7A), the resultant is stirred and mixed for 30 minutes, 9.0 parts by mass of methylglycine diacetate (Trilon M, made by BASF Corporation, with an effective content of 40% by mass) are added thereto for 5 minutes, and 120 parts by mass of a 1% by mass sodium hydroxide solution is added thereto.

Thereafter, the temperature is raised at a temperature rising rate of 1° C./min to 95° C. while adding 4 parts by mass of the 1% by mass sodium hydroxide solution every 5° C., and the temperature is held at 95° C. After reaching 95° C., the pH is lowered by 0.05 every 10 minutes by the use of a 1.0% by mass acetic acid solution, the shape factor is measured by the use of FPIA-3000 (made by Sysmex Corporation), and the vessel is cooled to 30° C. with a coolant for 5 minutes when the average shape factor is 0.964.

The cooled slurry is made to pass through a nylon mesh with apertures of 20 μm to remove coarse particles, and the toner slurry passing through the mesh is depressurized and filtrated with an aspirator and is separated into solid and liquid. The toner remaining in the filter paper is pulverized, the resultant is input to ion-exchange water of 10 times the amount of toner at a temperature of 30° C., the resultant is stirred and mixed for 30 minutes, and the resultant is separated into solid and liquid again by the use of an aspirator. This operation is repeated until the conductivity of the filtrate is equal to or less than 10 μS/cm, and the toner is washed.

The washed toner is finely pulverized by the use of a wet and dry granulator (Comil), and the resultant is dried in vacuum in an oven of 35° C. for 36 hours, whereby toner particles are obtained. 1.0 parts by mass of hydrophobic silica (RY50, made by Nippon Aerosil Co., Ltd.) is added to 100 parts by mass of the obtained toner particles and the resultant is mixed at 13000 rpm for 30 seconds by the use of a sample mill. Thereafter, the resultant is sieved by the use of a vibrating sieve with apertures of 45 μm, whereby a toner (TNA7A) is obtained.

The obtained toner (TNA7A) has a volume-average particle diameter D50v of 6.0 μm and a shape factor SF1 of 0.965. As a result of observation of an SEM image of the toner, the surface of the toner is smooth and a problem with protrusion of the release agent, peeling of the surface layer, or the like does not occur.

Preparation of Developer (DTNA7A)

40 parts by mass of the toner (TNA7A) is added to 500 parts by mass of the resin-coated carrier (C), the resultant is mixed for 20 minutes by the use of a V-shaped mixer, and aggregates are removed by the use of a vibrating sieve with apertures of 212 μm, whereby a developer (DTNA7A) is prepared.

Example 8

Preparation of Amorphous Polyester Resin Particle Dispersion (DA-A81)

A jacketed 3-liter reaction vessel (BJ-30N, made by Tokyo Rikakikai Co., LTD.) equipping with a condenser, a thermometer, a water dropping device, and an anchor blade is held at 40° C. by the use of a water-circulation thermostatic bath, a mixture solvent of 180 parts by mass of ethyl acetate and 80 parts by mass of isopropyl alcohol is input to the reaction vessel, 300 parts by mass of the amorphous polyester resin (PES-A3) is input thereto, and the resultant is stirred and dissolved at 150 rpm by the use of a three-one motor, whereby an oil phase is obtained. 50 parts by mass of a 5% by mass sodium hydroxide solution is dropped to the oil phase under stirring for 5 minutes, the resultant is mixed for 10 minutes, and 900 parts by mass of ion-exchange water is dropped thereto at a rate of 5 parts by mass per minute to change the phase, whereby an emulsified liquid is obtained.

Immediately, 800 parts by mass of the obtained emulsified liquid and 700 parts by mass of ion-exchange water are input to a 2-L recovery flask and the recovery flask is set in an evaporator (made by Tokyo Rikakikai Co., LTD.) including a vacuum control unit via a spherical trap. The recovery flask is heated in a water bath of 60° C. while rotating and is depressurized to 7 kPa to remove the solvent while watching the bumping. When the amount of solvent collected reaches 1000 parts by mass, and the pressure is returned to a normal pressure and the recovery flask is cooled with water, whereby a dispersion is obtained. There is no solvent odor in the obtained dispersion. The volume-average particle diameter D50v of the resin particles in the dispersion is 150 nm. Thereafter, an anionic surfactant (DowFax 2A1, made by Dow Chemical Co., with an effective content of 45% by mass) is mixed therewith by 2% by mass as an effective component with respect to the resin content in the dispersion, ion-exchange water is added thereto to adjust the solid concentration to 20% by mass. The resultant is used as an amorphous polyester resin particle dispersion (DA-A81).

Preparation of Amorphous Polyester Resin Particle Dispersion (DA-A82)

An amorphous polyester resin particle dispersion (DA-A82) is obtained in the same way as preparing the amorphous polyester resin particle dispersion (DA-A81), except that the amorphous polyester resin (PES-A3) is replaced with the amorphous polyester resin (PES-A4). The volume-average particle diameter D50v of resin particles in the amorphous polyester resin particle dispersion (DA-A82) is 150 nm.

Preparation of Added Amorphous Polyester Resin Particle Dispersion (DA-A8A)

Amorphous polyester resin particle dispersion (DA-A81): 160 parts by mass

Amorphous polyester resin particle dispersion (DA-A82): 160 parts by mass

The materials are input to a 500 ml beaker and are stirred at a rate not generating bubbles by the use of a magnetic stirrer, and pH is adjusted to 4.0 using a 1.0% by mass acetic acid solution, whereby an added amorphous polyester resin particle dispersion (DA-ABA) is obtained.

Preparation of Aluminum Sulfate Solution (SA8A)

Aluminum sulfate powder (17% aluminum sulfate, made by Asada Chemical Industry Co., Ltd.): 1.2 parts by mass Ion-exchange water: 20 parts by mass The materials are input to a 30 ml vessel and are stirred and mixed at 30° C. until the precipitates disappear, whereby an aluminum sulfate solution (SA8A) is prepared.

Preparation of Toner (TNA8A)

Amorphous polyester resin particle dispersion (DA-A81): 380 parts by mass

Amorphous polyester resin particle dispersion (DA-A82): 380 parts by mass

Release agent dispersion (DW1): 130 parts by mass

Colorant dispersion (PDK1): 100 parts by mass

Ion-exchange water: 650 parts by mass

The materials are input to a 3-L reaction vessel equipping with a thermometer, a pH meter, and a stirrer, a 1.0% by mass acetic acid is added thereto at a temperature of 25° C. to adjust pH to 4.0 while stirring the resultant to such an extent not to generate a vortex, the prepared aluminum sulfate solution (SA8A) is totally added thereto while dispersing the resultant at 5000 rpm by the use of a homogenizer (Ultratracks T50, made by IKA Japan), and the resultant is dispersed for 6 minutes.

Thereafter, a mantel heater is installed in the reaction vessel, the number of rotations of the stirrer is adjusted to maintain a state where slurry is sufficiently stirred, the temperature is raised at a temperature rising rate of 0.2° C./min before 40° C., at a temperature rising rate of 0.1° C./min after 40° C., and at a temperature rising rate of 0.02° C./min after 45° C., and the particle diameter is measured by the use of Multisizer every 10 minutes. When the volume-average particle diameter is 5.0 μm, all the added amorphous polyester resin particle dispersion (DA-A8A) is input thereto for 60 minutes.

After inputting the added amorphous polyester resin particle dispersion (DA-ABA), the resultant is stirred and mixed for 30 minutes, 9.0 parts by mass of methylglycine diacetate (Trilon M, made by BASF Corporation, with an effective content of 40% by mass) are added thereto for 5 minutes, and 110 parts by mass of a 1% by mass sodium hydroxide solution is added thereto.

Thereafter, the temperature is raised at a temperature rising rate of 1° C./min to 95° C. while adding 4 parts by mass of the 1% by mass sodium hydroxide solution every 5° C., and the temperature is held at 95° C. After reaching 95° C., the pH is lowered by 0.05 every 10 minutes by the use of a 1.0% by mass acetic acid solution, the shape factor is measured by the use of FPIA-3000 (made by Sysmex Corporation), and the vessel is cooled to 30° C. with a coolant for 5 minutes when the average shape factor is 0.964.

The cooled slurry is made to pass through a nylon mesh with apertures of 20 μm to remove coarse particles, and the toner slurry passing through the mesh is depressurized and filtrated with an aspirator and is separated into solid and liquid. The toner remaining in the filter paper is pulverized, the resultant is input to ion-exchange water of 10 times the amount of toner at a temperature of 30° C., the resultant is stirred and mixed for 30 minutes, and the resultant is separated into solid and liquid again by the use of an aspirator. This operation is repeated until the conductivity of the filtrate is equal to or less than 10 μS/cm, and the toner is washed.

The washed toner is finely pulverized by the use of a wet and dry granulator (Comil), and the resultant is dried in vacuum in an oven of 35° C. for 36 hours, whereby toner particles are obtained. 1.0 parts by mass of hydrophobic silica (RY50, made by Nippon Aerosil Co., Ltd.) is added to 100 parts by mass of the obtained toner particles and the resultant is mixed at 13000 rpm for 30 seconds by the use of a sample mill. Thereafter, the resultant is sieved by the use of a vibrating sieve with apertures of 45 μm, whereby a toner (TNA8A) is obtained.

The obtained toner (TNA8A) has a volume-average particle diameter D50v of 5.9 μm and a shape factor SF1 of 0.964. As a result of observation of an SEM image of the toner, the surface of the toner is smooth and a problem with protrusion of the release agent, peeling of the surface layer, or the like does not occur.

Preparation of Developer (DTNA8A)

40 parts by mass of the toner (TNA8A) is added to 500 parts by mass of the resin-coated carrier (C), the resultant is mixed for 20 minutes by the use of a V-shaped mixer, and aggregates are removed by the use of a vibrating sieve with apertures of 212 μm, whereby a developer (DTNA8A) is prepared.

Example 9

Preparation of Amorphous Polyester Resin Particle Dispersion (DA-A91)

A jacketed 3-liter reaction vessel (BJ-30N, made by Tokyo Rikakikai Co., LTD.) equipping with a condenser, a thermometer, a water dropping device, and an anchor blade is held at 40° C. by the use of a water-circulation thermostatic bath, a mixture solvent of 180 parts by mass of ethyl acetate and 80 parts by mass of isopropyl alcohol is input to the reaction vessel, 300 parts by mass of the amorphous polyester resin (PES-A3) is input thereto, and the resultant is stirred and dissolved at 150 rpm by the use of a three-one motor, whereby an oil phase is obtained. A mixture solution of 8 parts by mass of a 10% by mass ammonia solution and 15 parts by mass of a 5% by mass sodium hydroxide solution is dropped to the oil phase under stirring for 5 minutes, the resultant is mixed for 10 minutes, and 900 parts by mass of ion-exchange water is dropped thereto at a rate of 5 parts by mass per minute to change the phase, whereby an emulsified liquid is obtained.

Immediately, 800 parts by mass of the obtained emulsified liquid and 700 parts by mass of ion-exchange water are input to a 2-L recovery flask and the recovery flask is set in an evaporator (made by Tokyo Rikakikai Co., LTD.) including a vacuum control unit via a spherical trap. The recovery flask is heated in a water bath of 60° C. while rotating and is depressurized to 7 kPa to remove the solvent while watching the bumping. When the amount of solvent collected reaches 1000 parts by mass, and the pressure is returned to a normal pressure and the recovery flask is cooled with water, whereby a dispersion is obtained. There is no solvent odor in the obtained dispersion. The volume-average particle diameter D50v of the resin particles in the dispersion is 140 nm. Thereafter, an anionic surfactant (DowFax 2A1, made by Dow Chemical Co., with an effective content of 45% by mass) is mixed therewith by 2% by mass as an effective component with respect to the resin content in the dispersion, ion-exchange water is added thereto to adjust the solid concentration to 20% by mass. The resultant is used as an amorphous polyester resin particle dispersion (DA-A91).

Preparation of Amorphous Polyester Resin Particle Dispersion (DA-A92)

An amorphous polyester resin particle dispersion (DA-A92) is obtained in the same way as preparing the amorphous polyester resin particle dispersion (DA-A91), except that the amorphous polyester resin (PES-A3) is replaced with the amorphous polyester resin (PES-A4). The volume-average particle diameter D50v of resin particles in the amorphous polyester resin particle dispersion (DA-A92) is 140 nm.

Preparation of Crystalline Polyester Resin Particle Dispersion (DA-C9)

A jacketed 3-liter reaction vessel (BJ-30N, made by Tokyo Rikakikai Co., LTD.) equipping with a condenser, a thermometer, a water dropping device, and an anchor blade is held at 40° C. by the use of a water-circulation thermostatic bath, 180 parts by mass of methylethyl ketone and 80 parts by mass of isopropyl alcohol is input to the reaction vessel, 300 parts by mass of the crystalline polyester resin (PES-C1) is input thereto, the temperature of the solution is raised to 65° C., and the resultant is stirred and dissolved at 150 rpm by the use of a three-one motor, whereby an oil phase is obtained. 15 parts by mass of a 10% by mass ammonia solution is dropped to the oil phase under stirring for 5 minutes, the resultant is mixed for 10 minutes, and 900 parts by mass of ion-exchange water is dropped thereto at a rate of 5 parts by mass per minute to change the phase, whereby an emulsified liquid is obtained.

Immediately, 800 parts by mass of the obtained emulsified liquid and 700 parts by mass of ion-exchange water are input to a 2-L recovery flask and the recovery flask is set in an evaporator (made by Tokyo Rikakikai Co., LTD.) including a vacuum control unit via a spherical trap. The recovery flask is heated in a water bath of 60° C. while rotating and is depressurized to 7 kPa to remove the solvent while watching the bumping. When the amount of solvent collected reaches 1000 parts by mass, and the pressure is returned to a normal pressure and the recovery flask is cooled with water, whereby a dispersion is obtained. There is no solvent odor in the obtained dispersion. The volume-average particle diameter D50v of the resin particles in the dispersion is 170 nm. Thereafter, an anionic surfactant (DowFax 2A1, made by Dow Chemical Co., with an effective content of 45% by mass) is mixed therewith by 2% by mass as an effective component with respect to the resin content in the dispersion, ion-exchange water is added thereto to adjust the solid concentration to 20% by mass. The resultant is used as a crystalline polyester resin particle dispersion (DA-C9).

Preparation of Added Amorphous Polyester Resin Particle Dispersion (DA-A9A)

Amorphous polyester resin particle dispersion (DA-A91): 160 parts by mass

Amorphous polyester resin particle dispersion (DA-A92): 160 parts by mass

The materials are input to a 500 ml beaker and are stirred at a rate not generating bubbles by the use of a magnetic stirrer, and pH is adjusted to 4.0 using a 1.0% by mass acetic acid solution, whereby an added amorphous polyester resin particle dispersion (DA-A9A) is obtained.

Preparation of Aluminum Sulfate Solution (SA9A)

Aluminum sulfate powder (17% aluminum sulfate, made by Asada Chemical Industry Co., Ltd.): 1.2 parts by mass Ion-exchange water: 20 parts by mass The materials are input to a 30 ml vessel and are stirred and mixed at 30° C. until the precipitates disappear, whereby an aluminum sulfate solution (SA9A) is prepared.

Preparation of Toner (TNA9A)

Amorphous polyester resin particle dispersion (DA-A91): 350 parts by mass

Amorphous polyester resin particle dispersion (DA-A92): 350 parts by mass

Crystalline polyester resin particle dispersion (DA-C9): 65 parts by mass

Release agent dispersion (DW1): 130 parts by mass

Colorant dispersion (PDK1): 100 parts by mass

Ion-exchange water: 600 parts by mass

The materials are input to a 3-L reaction vessel equipping with a thermometer, a pH meter, and a stirrer, a 1.0% by mass acetic acid is added thereto at a temperature of 25° C. to adjust pH to 4.0 while stirring the resultant to such an extent not to generate a vortex, the prepared aluminum sulfate solution (SA9A) is totally added thereto while dispersing the resultant at 5000 rpm by the use of a homogenizer (Ultratracks T50, made by IKA Japan), and the resultant is dispersed for 6 minutes.

Thereafter, a mantel heater is installed in the reaction vessel, the number of rotations of the stirrer is adjusted to maintain a state where slurry is sufficiently stirred, the temperature is raised at a temperature rising rate of 0.2° C./min before 40° C., at a temperature rising rate of 0.1° C./min after 40° C., and at a temperature rising rate of 0.02° C./min after 45° C., and the particle diameter is measured by the use of Multisizer every 10 minutes. When the volume-average particle diameter is 5.0 μm, all the added amorphous polyester resin particle dispersion (DA-A9A) is input thereto for 60 minutes.

After inputting the added amorphous polyester resin particle dispersion (DA-A9A), the resultant is stirred and mixed for 30 minutes, 9.0 parts by mass of methylglycine diacetate (Trilon M, made by BASF Corporation, with an effective content of 40% by mass) are added thereto for 5 minutes, and 110 parts by mass of a 1% by mass sodium hydroxide solution is added thereto.

Thereafter, the temperature is raised at a temperature rising rate of 1° C./min to 95° C. while adding 4 parts by mass of the 1% by mass sodium hydroxide solution every 5° C., and the temperature is held at 95° C. After reaching 95° C., the pH is lowered by 0.05 every 10 minutes by the use of a 1.0% by mass acetic acid solution, the shape factor is measured by the use of FPIA-3000 (made by Sysmex Corporation), and the vessel is cooled to 30° C. with a coolant for 5 minutes when the average shape factor is 0.964.

The cooled slurry is made to pass through a nylon mesh with apertures of 20 μm to remove coarse particles, and the toner slurry passing through the mesh is depressurized and filtrated with an aspirator and is separated into solid and liquid. The toner remaining in the filter paper is pulverized, the resultant is input to ion-exchange water of 10 times the amount of toner at a temperature of 30° C., the resultant is stirred and mixed for 30 minutes, and the resultant is separated into solid and liquid again by the use of an aspirator. This operation is repeated until the conductivity of the filtrate is equal to or less than 10 μS/cm, and the toner is washed.

The washed toner is finely pulverized by the use of a wet and dry granulator (Comil), and the resultant is dried in vacuum in an oven of 35° C. for 36 hours, whereby toner particles are obtained. 1.0 parts by mass of hydrophobic silica (RY50, made by Nippon Aerosil Co., Ltd.) is added to 100 parts by mass of the obtained toner particles and the resultant is mixed at 13000 rpm for 30 seconds by the use of a sample mill. Thereafter, the resultant is sieved by the use of a vibrating sieve with apertures of 45 μm, whereby a toner (TNA9A) is obtained.

The obtained toner (TNA9A) has a volume-average particle diameter D50v of 5.9 μm and a shape factor SF1 of 0.964. As a result of observation of an SEM image of the toner, the surface of the toner is smooth and a problem with protrusion of the release agent, peeling of the surface layer, or the like does not occur.

Preparation of Developer (DTNA9A)

40 parts by mass of the toner (TNA9A) is added to 500 parts by mass of the resin-coated carrier (C), the resultant is mixed for 20 minutes by the use of a V-shaped mixer, and aggregates are removed by the use of a vibrating sieve with apertures of 212 μm, whereby a developer (DTNA9A) is prepared.

Example 10

A toner (TNA10A) is obtained in the same way as in Example 9, except that the crystalline polyester resin is changed from PES-C1 to PES-C2.

The obtained toner (TNA10A) has a volume-average particle diameter D50v of 6.1 μm and a shape factor SF1 of 0.967. As a result of observation of an SEM image of the toner, the surface of the toner is smooth and a problem with protrusion of the release agent, peeling of the surface layer, or the like does not occur.

Preparation of Developer (DTNA10A)

40 parts by mass of the toner (TNA10A) is added to 500 parts by mass of the resin-coated carrier (C), the resultant is mixed for 20 minutes by the use of a V-shaped mixer, and aggregates are removed by the use of a vibrating sieve with apertures of 212 μm, whereby a developer (DTNA10A) is prepared.

Example 11

Preparation of Amorphous Polyester Resin Particle Dispersion (DA-A111)

A jacketed 3-liter reaction vessel (BJ-30N, made by Tokyo Rikakikai Co., LTD.) equipping with a condenser, a thermometer, a water dropping device, and an anchor blade is held at 40° C. by the use of a water-circulation thermostatic bath, a mixture solvent of 250 parts by mass of ethyl acetate and 30 parts by mass of isopropyl alcohol is input to the reaction vessel, 300 parts by mass of the amorphous polyester resin (PES-A6) is input thereto, and the resultant is stirred and dissolved at 150 rpm by the use of a three-one motor, whereby an oil phase is obtained. A mixture solution of 8 parts by mass of a 10% by mass ammonia solution and 15 parts by mass of a 5% by mass sodium hydroxide solution is dropped to the oil phase under stirring for 5 minutes, the resultant is mixed for 10 minutes, and 900 parts by mass of ion-exchange water is dropped thereto at a rate of 5 parts by mass per minute to change the phase, whereby an emulsified liquid is obtained.

Immediately, 800 parts by mass of the obtained emulsified liquid and 700 parts by mass of ion-exchange water are input to a 2-L recovery flask and the recovery flask is set in an evaporator (made by Tokyo Rikakikai Co., LTD.) including a vacuum control unit via a spherical trap. The recovery flask is heated in a water bath of 60° C. while rotating and is depressurized to 7 kPa to remove the solvent while watching the bumping. When the amount of solvent collected reaches 1000 parts by mass, and the pressure is returned to a normal pressure and the recovery flask is cooled with water, whereby a dispersion is obtained. There is no solvent odor in the obtained dispersion. The volume-average particle diameter D50v of the resin particles in the dispersion is 120 nm. Thereafter, an anionic surfactant (DowFax 2A1, made by Dow Chemical Co., with an effective content of 45% by mass) is mixed therewith by 2% by mass as an effective component with respect to the resin content in the dispersion, ion-exchange water is added thereto to adjust the solid concentration to 20% by mass. The resultant is used as an amorphous polyester resin particle dispersion (DA-A111).

Preparation of Amorphous Polyester Resin Particle Dispersion (DA-A112)

An amorphous polyester resin particle dispersion (DA-A112) is obtained in the same way as preparing the amorphous polyester resin particle dispersion (DA-A92). The volume-average particle diameter D50v of resin particles in the amorphous polyester resin particle dispersion (DA-A112) is 140 nm.

Preparation of Crystalline Polyester Resin Particle Dispersion (DA-C11)

A jacketed 3-liter reaction vessel (BJ-30N, made by Tokyo Rikakikai Co., LTD.) equipping with a condenser, a thermometer, a water dropping device, and an anchor blade is held at 40° C. by the use of a water-circulation thermostatic bath, 180 parts by mass of methylethyl ketone and 80 parts by mass of isopropyl alcohol is input to the reaction vessel, 300 parts by mass of the crystalline polyester resin (PES-C2) is input thereto, the temperature of the solution is raised to 65° C., and the resultant is stirred and dissolved at 150 rpm by the use of a three-one motor, whereby an oil phase is obtained. 15 parts by mass of a 10% by mass ammonia solution is dropped to the oil phase under stirring for 5 minutes, the resultant is mixed for 10 minutes, and 900 parts by mass of ion-exchange water is dropped thereto at a rate of 5 parts by mass per minute to change the phase, whereby an emulsified liquid is obtained.

Immediately, 800 parts by mass of the obtained emulsified liquid and 700 parts by mass of ion-exchange water are input to a 2-L recovery flask and the recovery flask is set in an evaporator (made by Tokyo Rikakikai Co., LTD.) including a vacuum control unit via a spherical trap. The recovery flask is heated in a water bath of 60° C. while rotating and is depressurized to 7 kPa to remove the solvent while watching the bumping. When the amount of solvent collected reaches 1000 parts by mass, and the pressure is returned to a normal pressure and the recovery flask is cooled with water, whereby a dispersion is obtained. There is no solvent odor in the obtained dispersion. The volume-average particle diameter D50v of the resin particles in the dispersion is 170 nm. Thereafter, an anionic surfactant (DowFax 2A1, made by Dow Chemical Co., with an effective content of 45% by mass) is mixed therewith by 2% by mass as an effective component with respect to the resin content in the dispersion, ion-exchange water is added thereto to adjust the solid concentration to 20% by mass. The resultant is used as a crystalline polyester resin particle dispersion (DA-C11).

Preparation of Added Amorphous Polyester Resin Particle Dispersion (DA-A11A)

- Amorphous polyester resin particle dispersion (DA-A111): 160 parts by mass
- Amorphous polyester resin particle dispersion (DA-A112): 160 parts by mass The materials are input to a 500 ml beaker and are stirred at a rate not generating bubbles by the use of a magnetic stirrer, and pH is adjusted to 4.0 using a 1.0% by mass acetic acid solution, whereby an added amorphous polyester resin particle dispersion (DA-A11A) is obtained.

Preparation of Aluminum Sulfate Solution (SA11A)

- Aluminum sulfate powder (17% aluminum sulfate, made by Asada Chemical Industry Co., Ltd.): 1.2 parts by mass
- Ion-exchange water: 20 parts by mass The materials are input to a 30 ml vessel and are stirred and mixed at 30° C. until the precipitates disappear, whereby an aluminum sulfate solution (SA11A) is prepared.

Preparation of Toner (TNA11A)

- Amorphous polyester resin particle dispersion (DA-A111): 350 parts by mass
- Amorphous polyester resin particle dispersion (DA-A112): 350 parts by mass
- Crystalline polyester resin particle dispersion (DA-C11): 65 parts by mass
- Release agent dispersion (DW1): 130 parts by mass
- Colorant dispersion (PDK1): 100 parts by mass
- Ion-exchange water: 600 parts by mass The materials are input to a 3-L reaction vessel equipping with a thermometer, a pH meter, and a stirrer, a 1.0% by mass acetic acid is added thereto at a temperature of 25° C. to adjust pH to 4.0 while stirring the resultant to such an extent not to generate a vortex, the prepared aluminum sulfate solution (SA11A) is totally added thereto while dispersing the resultant at 5000 rpm by the use of a homogenizer (Ultratracks T50, made by IKA Japan), and the resultant is dispersed for 6 minutes.

Thereafter, a mantel heater is installed in the reaction vessel, the number of rotations of the stirrer is adjusted to maintain a state where slurry is sufficiently stirred, the temperature is raised at a temperature rising rate of 0.2° C./min before 40° C., at a temperature rising rate of 0.1° C./min after 40° C., and at a temperature rising rate of 0.02° C./min after 45° C., and the particle diameter is measured by the use of Multisizer every 10 minutes. When the volume-average particle diameter is 5.0 μm, all the added amorphous polyester resin particle dispersion (DA-A11A) is input thereto for 60 minutes.

After inputting the added amorphous polyester resin particle dispersion (DA-A11A), the resultant is stirred and mixed for 30 minutes, 9.0 parts by mass of methylglycine diacetate (Trilon M, made by BASF Corporation, with an effective content of 40% by mass) are added thereto for 5 minutes, and 130 parts by mass of a 1% by mass sodium hydroxide solution is added thereto.

Thereafter, the temperature is raised at a temperature rising rate of 1° C./min to 95° C. while adding 4 parts by mass of the 1% by mass sodium hydroxide solution every 5° C., and the temperature is held at 95° C. After reaching 95° C., the pH is lowered by 0.05 every 10 minutes by the use of a 1.0% by mass acetic acid solution, the shape factor is measured by the use of FPIA-3000 (made by Sysmex Corporation), and the vessel is cooled to 30° C. with a coolant for 5 minutes when the average shape factor is 0.964.

The cooled slurry is made to pass through a nylon mesh with apertures of 20 μm to remove coarse particles, and the toner slurry passing through the mesh is depressurized and filtrated with an aspirator and is separated into solid and liquid. The toner remaining in the filter paper is pulverized, the resultant is input to ion-exchange water of 10 times the amount of toner at a temperature of 30° C., the resultant is stirred and mixed for 30 minutes, and the resultant is separated into solid and liquid again by the use of an aspirator. This operation is repeated until the conductivity of the filtrate is equal to or less than 10 μS/cm, and the toner is washed.

The washed toner is finely pulverized by the use of a wet and dry granulator (Comil), and the resultant is dried in vacuum in an oven of 35° C. for 36 hours, whereby toner particles are obtained. 1.0 parts by mass of hydrophobic silica (RY50, made by Nippon Aerosil Co., Ltd.) is added to 100 parts by mass of the obtained toner particles and the resultant is mixed at 13000 rpm for 30 seconds by the use of a sample mill. Thereafter, the resultant is sieved by the use of a vibrating sieve with apertures of 45 μm, whereby a toner (TNA11A) is obtained.

The obtained toner (TNA11A) has a volume-average particle diameter D50v of 6.2 μm and a shape factor SF1 of 0.965. As a result of observation of an SEM image of the toner, the surface of the toner is smooth and a problem with protrusion of the release agent, peeling of the surface layer, or the like does not occur.

Preparation of Developer (DTNA11A)

40 parts by mass of the toner (TNA11A) is added to 500 parts by mass of the resin-coated carrier (C), the resultant is mixed for 20 minutes by the use of a V-shaped mixer, and aggregates are removed by the use of a vibrating sieve with apertures of 212 μm, whereby a developer (DTNA11A) is prepared.

Example 12

Preparation of Amorphous Polyester Resin Particle Dispersion (DA-A121)

A jacketed 3-liter reaction vessel (BJ-30N, made by Tokyo Rikakikai Co., LTD.) equipping with a condenser, a thermometer, a water dropping device, and an anchor blade is held at 40° C. by the use of a water-circulation thermostatic bath, a mixture solvent of 180 parts by mass of ethyl acetate and 80 parts by mass of isopropyl alcohol is input to the reaction vessel, 300 parts by mass of the amorphous polyester resin (PES-A3) is input thereto, and the resultant is stirred and dissolved at 150 rpm by the use of a three-one motor, whereby an oil phase is obtained. A mixture solution of 8 parts by mass of a 10% by mass ammonia solution and 15 parts by mass of a 5% by mass sodium hydroxide solution is dropped to the oil phase under stirring for 5 minutes, the resultant is mixed for 10 minutes, and 900 parts by mass of ion-exchange water is dropped thereto at a rate of 5 parts by mass per minute to change the phase, whereby an emulsified liquid is obtained.

Immediately, 800 parts by mass of the obtained emulsified liquid and 700 parts by mass of ion-exchange water are input to a 2-L recovery flask and the recovery flask is set in an evaporator (made by Tokyo Rikakikai Co., LTD.) including a vacuum control unit via a spherical trap. The recovery flask is heated in a water bath of 60° C. while rotating and is depressurized to 7 kPa to remove the solvent while watching the bumping. When the amount of solvent collected reaches 1000 parts by mass, and the pressure is returned to a normal pressure and the recovery flask is cooled with water, whereby a dispersion is obtained. There is no solvent odor in the obtained dispersion. The volume-average particle diameter D50v of the resin particles in the dispersion is 140 nm. Thereafter, an anionic surfactant (DowFax 2A1, made by Dow Chemical Co., with an effective content of 45% by mass) is mixed therewith by 2% by mass as an effective component with respect to the resin content in the dispersion, ion-exchange water is added thereto to adjust the solid concentration to 20% by mass. The resultant is used as an amorphous polyester resin particle dispersion (DA-A121).

Preparation of Amorphous Polyester Resin Particle Dispersion (DA-A122)

An amorphous polyester resin particle dispersion (DA-A122) is obtained in the same way as preparing the amorphous polyester resin particle dispersion (DA-A121), except that the amorphous polyester resin (PES-A3) is replaced with the amorphous polyester resin (PES-A4). The volume-average particle diameter D50v of resin particles in the amorphous polyester resin particle dispersion (DA-A122) is 140 nm.

Preparation of Added Amorphous Polyester Resin Particle Dispersion (DA-A12A)

- Amorphous polyester resin particle dispersion (DA-A121): 160 parts by mass
- Amorphous polyester resin particle dispersion (DA-A122): 160 parts by mass The materials are input to a 500 ml beaker and are stirred at a rate not generating bubbles by the use of a magnetic stirrer, and pH is adjusted to 4.0 using a 1.0% by mass acetic acid solution, whereby an added amorphous polyester resin particle dispersion (DA-A12A) is obtained.

Preparation of Aluminum Sulfate Solution (SA12A)

- Aluminum sulfate powder (17% aluminum sulfate, made by Asada Chemical Industry Co., Ltd.): 1.2 parts by mass
- Ion-exchange water: 20 parts by mass The materials are input to a 30 ml vessel and are stirred and mixed at 30° C. until the precipitates disappear, whereby an aluminum sulfate solution (SA12A) is prepared.

Preparation of Toner (TNA12A)

- Amorphous polyester resin particle dispersion (DA-A121): 380 parts by mass
- Amorphous polyester resin particle dispersion (DA-A122): 380 parts by mass
- Release agent dispersion (DW1): 130 parts by mass,
- Colorant dispersion (PDK1): 100 parts by mass
- Ion-exchange water: 600 parts by mass The materials are input to a 3-L reaction vessel equipping with a thermometer, a pH meter, and a stirrer, a 1.0% by mass acetic acid is added thereto at a temperature of 25° C. to adjust pH to 4.0 while stirring the resultant to such an extent not to generate a vortex, the prepared aluminum sulfate solution (SA12A) is totally added thereto while dispersing the resultant at 5000 rpm by the use of a homogenizer (Ultratracks T50, made by IKA Japan), and the resultant is dispersed for 6 minutes.

Thereafter, a mantel heater is installed in the reaction vessel, the number of rotations of the stirrer is adjusted to maintain a state where slurry is sufficiently stirred, the temperature is raised at a temperature rising rate of 0.2° C./min before 40° C., at a temperature rising rate of 0.1° C./min after 40° C., and at a temperature rising rate of 0.02° C./min after 45° C., and the particle diameter is measured by the use of Multisizer every 10 minutes. When the volume-average particle diameter is 5.0 μm, all the added amorphous polyester resin particle dispersion (DA-A12A) is input thereto for 60 minutes.

After inputting the added amorphous polyester resin particle dispersion (DA-A12A), the resultant is stirred and mixed for 30 minutes, 9.0 parts by mass of methylglycine diacetate (Trilon M, made by BASF Corporation, with an effective content of 40% by mass) are added thereto for 5 minutes, and 110 parts by mass of a 1% by mass sodium hydroxide solution is added thereto.

Thereafter, the temperature is raised at a temperature rising rate of 1° C./min to 95° C. while adding 4 parts by mass of the 1% by mass sodium hydroxide solution every 5° C., and the temperature is held at 95° C. After reaching 95° C., the pH is lowered by 0.05 every 10 minutes by the use of a 1.0% by mass acetic acid solution, the shape factor is measured by the use of FBIA-3000 (made by Sysmex Corporation), and the vessel is cooled to 30° C. with a coolant for 5 minutes when the average shape factor is 0.964.

The cooled slurry is made to pass through a nylon mesh with apertures of 20 μm to remove coarse particles, and the toner slurry passing through the mesh is depressurized and filtrated with an aspirator and is separated into solid and liquid. The toner remaining in the filter paper is pulverized, the resultant is input to ion-exchange water of 10 times the amount of toner at a temperature of 30° C., the resultant is stirred and mixed for 30 minutes, and the resultant is separated into solid and liquid again by the use of an aspirator. This operation is repeated until the conductivity of the filtrate is equal to or less than 10 μS/cm, and the toner is washed.

The washed toner is finely pulverized by the use of a wet and dry granulator (Comil), and the resultant is dried in vacuum in an oven of 35° C. for 36 hours, whereby toner particles are obtained. 1.0 parts by mass of hydrophobic silica (RY50, made by Nippon Aerosil Co., Ltd.) is added to 100 parts by mass of the obtained toner particles and the resultant is mixed at 13000 rpm for 30 seconds by the use of a sample mill. Thereafter, the resultant is sieved by the use of a vibrating sieve with apertures of 45 μm, whereby a toner (TNA12A) is obtained.

The obtained toner (TNA12A) has a volume-average particle diameter D50v of 5.8 μm and a shape factor SF1 of 0.964. As a result of observation of an SEM image of the toner, the surface of the toner is smooth and a problem with protrusion of the release agent, peeling of the surface layer, or the like does not occur.

Preparation of Developer (DTNA12A)

40 parts by mass of the toner (TNA12A) is added to 500 parts by mass of the resin-coated carrier (C), the resultant is mixed for 20 minutes by the use of a V-shaped mixer, and aggregates are removed by the use of a vibrating sieve with apertures of 212 μm, whereby a developer (DTNA12A) is prepared.

Example 13

Preparation of Amorphous Polyester Resin Particle Dispersion (DA-A131)

A jacketed 3-liter reaction vessel (BJ-30N, made by Tokyo Rikakikai Co., LTD.) equipping with a condenser, a thermometer, a water dropping device, and an anchor blade is held at 40° C. by the use of a water-circulation thermostatic bath, a mixture solvent of 180 parts by mass of ethyl acetate and 80 parts by mass of isopropyl alcohol is input to the reaction vessel, 300 parts by mass of the amorphous polyester resin (PES-A3) is input thereto, and the resultant is stirred and dissolved at 150 rpm by the use of a three-one motor, whereby an oil phase is obtained. A mixture solution of 8 parts by mass of a 10% by mass ammonia solution and 15 parts by mass of a 5% by mass sodium hydroxide solution is dropped to the oil phase under stirring for 5 minutes, the resultant is mixed for 10 minutes, and 900 parts by mass of ion-exchange water is dropped thereto at a rate of 5 parts by mass per minute to change the phase, whereby an emulsified liquid is obtained.

Immediately, 800 parts by mass of the obtained emulsified liquid and 700 parts by mass of ion-exchange water are input to a 2-L recovery flask and the recovery flask is set in an evaporator (made by Tokyo Rikakikai Co., LTD.) including a vacuum control unit via a spherical trap. The recovery flask is heated in a water bath of 60° C. while rotating and is depressurized to 7 kPa to remove the solvent while watching the bumping. When the amount of solvent collected reaches 1000 parts by mass, and the pressure is returned to a normal pressure and the recovery flask is cooled with water, whereby a dispersion is obtained. There is no solvent odor in the obtained dispersion. The volume-average particle diameter D50v of the resin particles in the dispersion is 140 nm. Thereafter, an anionic surfactant (DowFax 2A1, made by Dow Chemical Co., with an effective content of 45% by mass) is mixed therewith by 2% by mass as an effective component with respect to the resin content in the dispersion, ion-exchange water is added thereto to adjust the solid concentration to 20% by mass. The resultant is used as an amorphous polyester resin particle dispersion (DA-A131).

Preparation of Amorphous Polyester Resin Particle Dispersion (DA-A132)

An amorphous polyester resin particle dispersion (DA-A132) is obtained in the same way as preparing the amorphous polyester resin particle dispersion (DA-A131), except that the amorphous polyester resin (PES-A3) is replaced with the amorphous polyester resin (PES-A5). The volume-average particle diameter D50v of resin particles in the amorphous polyester resin particle dispersion (DA-A132) is 120 nm.

Preparation of Crystalline Polyester Resin Particle Dispersion (DA-C13)

A jacketed 3-liter reaction vessel (BJ-30N, made by Tokyo Rikakikai Co., LTD.) equipping with a condenser, a thermometer, a water dropping device, and an anchor blade is held at 40° C. by the use of a water-circulation thermostatic bath, 180 parts by mass of methylethyl ketone and 80 parts by mass of isopropyl alcohol are input to the reaction vessel, 300 parts by mass of the crystalline polyester resin (PES-C1) is input thereto, the temperature of the solution is raised to 65° C., and the resultant is stirred and dissolved at 150 rpm by the use of a three-one motor, whereby an oil phase is obtained. 15 parts by mass of a 10% by mass ammonia solution is dropped to the oil phase under stirring for 5 minutes, the resultant is mixed for 10 minutes, and 900 parts by mass of ion-exchange water is dropped thereto at a rate of 5 parts by mass per minute to change the phase, whereby an emulsified liquid is obtained.

Immediately, 800 parts by mass of the obtained emulsified liquid and 700 parts by mass of ion-exchange water are input to a 2-L recovery flask and the recovery flask is set in an evaporator (made by Tokyo Rikakikai Co., LTD.) including a vacuum control unit via a spherical trap. The recovery flask is heated in a water bath of 60° C. while rotating and is depressurized to 7 kPa to remove the solvent while watching the bumping. When the amount of solvent collected reaches 1000 parts by mass, and the pressure is returned to a normal pressure and the recovery flask is cooled with water, whereby a dispersion is obtained. There is no solvent odor in the obtained dispersion. The volume-average particle diameter D50v of the resin particles in the dispersion is 170 nm. Thereafter, an anionic surfactant (DowFax 2A1, made by Dow Chemical Co., with an effective content of 45% by mass) is mixed therewith by 2% by mass as an effective component with respect to the resin content in the dispersion, ion-exchange water is added thereto to adjust the solid concentration to 20% by mass. The resultant is used as a crystalline polyester resin particle dispersion (DA-C13).

Preparation of Added Amorphous Polyester Resin Particle Dispersion (DA-A13A)

- Amorphous polyester resin particle dispersion (DA-A131): 160 parts by mass
- Amorphous polyester resin particle dispersion (DA-A132): 160 parts by mass The materials are input to a 500 ml beaker and are stirred at a rate not generating bubbles by the use of a magnetic stirrer, and pH is adjusted to 4.0 using a 1.0% by mass acetic acid solution, whereby an added amorphous polyester resin particle dispersion (DA-A13A) is obtained.

Preparation of Aluminum Sulfate Solution (SA13A)

- Aluminum sulfate powder (17% aluminum sulfate, made by Asada Chemical Industry Co., Ltd.): 1.2 parts by mass
- Ion-exchange water: 20 parts by mass The materials are input to a 30 ml vessel and are stirred and mixed at 30° C. until the precipitates disappear, whereby an aluminum sulfate solution (SA13A) is prepared.

Preparation of Toner (TNA13A)

- Amorphous polyester resin particle dispersion (DA-A131): 350 parts by mass
- Amorphous polyester resin particle dispersion (DA-A132): 350 parts by mass
- Crystalline polyester resin particle dispersion (DA-C13): 65 parts by mass
- Release agent dispersion (DW1): 130 parts by mass
- Colorant dispersion (PDK1): 100 parts by mass
- Ion-exchange water: 600 parts by mass The materials are input to a 3-L reaction vessel equipping with a thermometer, a pH meter, and a stirrer, a 1.0% by mass acetic acid is added thereto at a temperature of 25° C. to adjust pH to 4.0 while stirring the resultant to such an extent not to generate a vortex, the prepared aluminum sulfate solution (SA13A) is totally added thereto while dispersing the resultant at 5000 rpm by the use of a homogenizer (Ultratracks T50, made by IKA Japan), and the resultant is dispersed for 6 minutes.

Thereafter, a mantel heater is installed in the reaction vessel, the number of rotations of the stirrer is adjusted to maintain a state where slurry is sufficiently stirred, the temperature is raised at a temperature rising rate of 0.2° C./min before 40° C., at a temperature rising rate of 0.1° C./min after 40° C., and at a temperature rising rate of 0.02° C./min after 45° C., and the particle diameter is measured by the use of Multisizer every 10 minutes. When the volume-average particle diameter is 5.0 μm, all the added amorphous polyester resin particle dispersion (DA-A13A) is input thereto for 60 minutes.

After inputting the added amorphous polyester resin particle dispersion (DA-A13A), the resultant is stirred and mixed for 30 minutes, 9.0 parts by mass of methylglycine diacetate (Trilon M, made by BASF Corporation, with an effective content of 40% by mass) are added thereto for 5 minutes, and 110 parts by mass of a 1% by mass sodium hydroxide solution is added thereto.

Thereafter, the temperature is raised at a temperature rising rate of 1° C./min to 95° C. while adding 4 parts by mass of the 1% by mass sodium hydroxide solution every 5° C., and the temperature is held at 95° C. After reaching 95° C., the pH is lowered by 0.05 every 10 minutes by the use of a 1.0% by mass acetic acid solution, the shape factor is measured by the use of FPIA-3000 (made by Sysmex Corporation), and the vessel is cooled to 30° C. with a coolant for 5 minutes when the average shape factor is 0.964.

The cooled slurry is made to pass through a nylon mesh with apertures of 20 μm to remove coarse particles, and the toner slurry passing through the mesh is depressurized and filtrated with an aspirator and is separated into solid and liquid. The toner remaining in the filter paper is pulverized, the resultant is input to ion-exchange water of 10 times the amount of toner at a temperature of 30° C., the resultant is stirred and mixed for 30 minutes, and the resultant is separated into solid and liquid again by the use of an aspirator. This operation is repeated until the conductivity of the filtrate is equal to or less than 10 μS/cm, and the toner is washed.

The washed toner is finely pulverized by the use of a wet and dry granulator (Comil), and the resultant is dried in vacuum in an oven of 35° C. for 36 hours, whereby toner particles are obtained. 1.0 parts by mass of hydrophobic silica (RY50, made by Nippon Aerosil Co., Ltd.) is added to 100 parts by mass of the obtained toner particles and the resultant is mixed at 13000 rpm for 30 seconds by the use of a sample mill. Thereafter, the resultant is sieved by the use of a vibrating sieve with apertures of 45 μm, whereby a toner (TNA13A) is obtained.

The obtained toner (TNA13A) has a volume-average particle diameter D50v of 5.9 μm and a shape factor SF1 of 0.963. As a result of observation of an SEM image of the toner, the surface of the toner is smooth and a problem with protrusion of the release agent, peeling of the surface layer, or the like does not occur.

Preparation of Developer (DTNA13A)

40 parts by mass of the toner (TNA13A) is added to 500 parts by mass of the resin-coated carrier (C), the resultant is mixed for 20 minutes by the use of a V-shaped mixer, and aggregates are removed by the use of a vibrating sieve with apertures of 212 μm, whereby a developer (DTNA13A) is prepared.

Comparative Example 1

- Amorphous polyester resin (PES-A5): 1275 parts by mass
- Hydrocarbon wax (product name: FNP0090, made by Nippon Seiro Co., Ltd., with a melting temperature of Tw=90.2° C.): 150 parts by mass
- Carbon black (REAGAL 330, made by Cabot Japan Corporation): 75 parts by mass The materials are kneaded and pulverized to obtain toner particles.

0.9 parts by mass of hydrophobic silica (RY50, made by Nippon Aerosil Co., Ltd.) is added to 100 parts by mass of the obtained toner particles and the resultant is mixed at 13000 rpm for 30 seconds by the use of a sample mill. Thereafter, the resultant is sieved by the use of a vibrating sieve with apertures of 45 μm, whereby a toner (TNB1B) is obtained. The obtained toner (TNAB1B) has a volume-average particle diameter D50v of 7.3 μm and a shape factor SF1 of 0.938.

Preparation of Developer (DTNB1B)

40 parts by mass of the toner (TNB1B) is added to 500 parts by mass of the resin-coated carrier (C), the resultant is mixed for 20 minutes by the use of a V-shaped mixer, and aggregates are removed by the use of a vibrating sieve with apertures of 212 μm, whereby a developer (DTNB1B) is prepared.

Comparative Example 2

Preparation of Amorphous Polyester Resin Particle Dispersion (DA-B21)

A jacketed 3-liter reaction vessel (BJ-30N, made by Tokyo Rikakikai Co., LTD.) equipping with a condenser, a thermometer, a water dropping device, and an anchor blade is held at 40° C. by the use of a water-circulation thermostatic bath, a mixture solvent of 180 parts by mass of ethyl acetate and 80 parts by mass of isopropyl alcohol is input to the reaction vessel, 300 parts by mass of the amorphous polyester resin (PES-A1) is input thereto, and the resultant is stirred and dissolved at 150 rpm by the use of a three-one motor, whereby an oil phase is obtained. A mixture solution of 8 parts by mass of a 10% by mass ammonia solution and 15 parts by mass of a 5% by mass sodium hydroxide solution is dropped to the oil phase under stirring for 5 minutes, the resultant is mixed for 10 minutes, and 900 parts by mass of ion-exchange water is dropped thereto at a rate of 5 parts by mass per minute to change the phase, whereby an emulsified liquid is obtained.

Immediately, 800 parts by mass of the obtained emulsified liquid and 700 parts by mass of ion-exchange water are input to a 2-L recovery flask and the recovery flask is set in an evaporator (made by Tokyo Rikakikai Co., LTD.) equipping with a vacuum control unit via a spherical trap. The recovery flask is heated in a water bath of 60° C. while rotating and is depressurized to 7 kPa to remove the solvent while watching the bumping. When the amount of solvent collected reaches 1000 parts by mass, and the pressure is returned to a normal pressure and the recovery flask is cooled with water, whereby a dispersion is obtained. There is no solvent odor in the obtained dispersion. The volume-average particle diameter D50v of the resin particles in the dispersion is 150 nm. Thereafter, an anionic surfactant (DowFax 2A1, made by Dow Chemical Co., with an effective content of 45% by mass) is mixed therewith by 2% by mass as an effective component with respect to the resin content in the dispersion, ion-exchange water is added thereto to adjust the solid concentration to 20% by mass. The resultant is used as an amorphous polyester resin particle dispersion (DA-B21).

Preparation of Amorphous Polyester Resin Particle Dispersion (DA-B22)

An amorphous polyester resin particle dispersion (DA-B22) is obtained in the same way as preparing the amorphous polyester resin particle dispersion (DA-B21), except that the amorphous polyester resin (PES-A1) is replaced with the amorphous polyester resin (PES-A2). The volume-average particle diameter D50v of resin particles in the amorphous polyester resin particle dispersion (DA-B22) is 110 nm.

Preparation of Added Amorphous Polyester Resin Particle Dispersion (DA-B2B)

Amorphous polyester resin particle dispersion (DA-B21): 160 parts by mass

Amorphous polyester resin particle dispersion (DA-B22): 160 parts by mass

The materials are input to a 500 ml beaker and are stirred at a rate not generating bubbles by the use of a magnetic stirrer, and pH is adjusted to 4.0 using a 1.0% by mass acetic acid solution, whereby an added amorphous polyester resin particle dispersion (DA-B2B) is obtained.

Preparation of Aluminum Sulfate Solution (SB2B)

Aluminum sulfate powder (17% aluminum sulfate, made by Asada Chemical Industry Co., Ltd.): 1.2 parts by mass Ion-exchange water: 20 parts by mass The materials are input to a 30 ml vessel and are stirred and mixed at 30° C. until the precipitates disappear, whereby an aluminum sulfate solution (SB2B) is prepared.

Preparation of Toner (TNB2B)

Amorphous polyester resin particle dispersion (DA-B21): 380 parts by mass

Amorphous polyester resin particle dispersion (DA-B22): 380 parts by mass

Release agent dispersion (DW1): 130 parts by mass

Colorant dispersion (PDK1): 100 parts by mass

Ion-exchange water: 600 parts by mass

The materials are input to a 3-L reaction vessel equipping with a thermometer, a pH meter, and a stirrer, a 1.0% by mass acetic acid is added thereto at a temperature of 25° C. to adjust pH to 4.0 while stirring the resultant to such an extent not to generate a vortex, the prepared aluminum sulfate solution (SB2B) is totally added thereto while dispersing the resultant at 5000 rpm by the use of a homogenizer (Ultratracks T50, made by IKA Japan), and the resultant is dispersed for 6 minutes.

Thereafter, a mantel heater is installed in the reaction vessel, the number of rotations of the stirrer is adjusted to maintain a state where slurry is sufficiently stirred, the temperature is raised at a temperature rising rate of 0.2° C./min before 40° C., at a temperature rising rate of 0.1° C./min after 40° C., and at a temperature rising rate of 0.02° C./min after 45° C., and the particle diameter is measured by the use of Multisizer every 10 minutes. When the volume-average particle diameter is 5.0 μm, all the added amorphous polyester resin particle dispersion (DA-B2B) is input thereto for 60 minutes.

After inputting the added amorphous polyester resin particle dispersion (DA-B2B), the resultant is stirred and mixed for 30 minutes, 10 parts by mass of EDTA (Chelest 40, made by Chelest Corporation, with an effective content of 40% by mass) is added thereto for 5 minutes, and 60 parts by mass of a 1% by mass sodium hydroxide solution is added thereto.

Thereafter, the temperature is raised at a temperature rising rate of 1° C./min to 95° C. while adding 4 parts by mass of the 1% by mass sodium hydroxide solution every 5° C., and the temperature is held at 95° C. After reaching 95° C., the pH is lowered by 0.05 every 10 minutes by the use of a 1.0% by mass acetic acid solution, the shape factor is measured by the use of FPIA-3000 (made by Sysmex Corporation), and the vessel is cooled to 30° C. with a coolant for 5 minutes when the average shape factor is 0.964.

The cooled slurry is made to pass through a nylon mesh with apertures of 20 μm to remove coarse particles, and the toner slurry passing through the mesh is depressurized and filtrated with an aspirator and is separated into solid and liquid. The toner remaining in the filter paper is pulverized, the resultant is input to ion-exchange water of 10 times the amount of toner at a temperature of 30° C., the resultant is stirred and mixed for 30 minutes, and the resultant is separated into solid and liquid again by the use of an aspirator. This operation is repeated until the conductivity of the filtrate is equal to or less than 10 μS/cm, and the toner is washed.

The washed toner is finely pulverized by the use of a wet and dry granulator (Comil), and the resultant is dried in vacuum in an oven of 35° C. for 36 hours, whereby toner particles are obtained. 1.0 parts by mass of hydrophobic silica (RY50, made by Nippon Aerosil Co., Ltd.) is added to 100 parts by mass of the obtained toner particles and the resultant is mixed at 13000 rpm for 30 seconds by the use of a sample mill. Thereafter, the resultant is sieved by the use of a vibrating sieve with apertures of 45 μm, whereby a toner (TNB2B) is obtained.

The obtained toner (TNB2B) has a volume-average particle diameter D50v of 5.8 μm and a shape factor SF1 of 0.964. As a result of observation of an SEM image of the toner, the surface of the toner is smooth and a problem with protrusion of the release agent, peeling of the surface layer, or the like does not occur.

Preparation of Developer (DTNB2B)

40 parts by mass of the toner (TNB2B) is added to 500 parts by mass of the resin-coated carrier (C), the resultant is mixed for 20 minutes by the use of a V-shaped mixer, and aggregates are removed by the use of a vibrating sieve with apertures of 212 whereby a developer (DTNB2B) is prepared.

CONCLUSION

Characteristics of the toners and evaluation results of the fixing test on the developers employing the toners are shown in Table 2

TABLE 2

| | Ex. 1 | Ex. 2 | Ex. 3 | Ex. 4 | Ex. 5 | Ex. 6 | Ex. 7 | Ex. 8 |
|---|---|---|---|---|---|---|---|---|
| Production method of toner | Wet | Wet | Wet | Wet | Wet | Wet | Wet | Wet |
| Type of amorphous resin | A1 + A2 | A1 + A2 | A1 + A2 | A1 + A2 | A1 + A2 | A1 + A2 | A1 + A2 | A3 + A4 |
| Type of crystalline resin | — | — | — | — | — | — | — | — |
| Alkyl side chain of amorphous resin | No | No | No | No | No | No | No | Yes |
| Residual quantity of methylglycine diacetate in toner | 7 | 500 | 5 | 500 | 300 | 250 | 100 | 250 |
| quantity of aluminum in toner | 0.07 | 0.07 | 0.18 | 0.16 | 0.10 | 0.12 | 0.13 | 0.13 |
| quantity of ammonia in toner | 0.02 | 0.01 | 0.02 | 0.01 | 0.01 | 0.30 | 0.60 | 0 |
| Difference in gloss between thin sheet and thick sheet | B | B | B | B | B | A | A | A |
| tanδ when viscosity is 10000 Pa · s | 1.2 | 1.2 | 0.5 | 0.7 | 1.0 | 1.0 | 0.9 | 0.7 |
| Lowest fixing temperature | 165 | 165 | 170 | 170 | 165 | 165 | 165 | 165 |
| Temperature of HOT offset generation | 210> | 210> | 210> | 210> | 210> | 210> | 210> | 210> |

| | Ex. 9 | Ex. 10 | Ex. 11 | Ex. 12 | Ex. 13 | Com. Ex. 1 | Com. Ex. 2 |
|---|---|---|---|---|---|---|---|
| Production method of toner | Wet | Wet | Wet | Wet | Wet | Kneading and pulverizing | Wet |
| Type of amorphous resin | A3 + A4 | A3 + A4 | A4 + A6 | A3 + A4 | A3 + A5 | A5 | A1 + A2 |
| Type of crystalline resin | C1 | C2 | C2 | — | C1 | — | — |
| Alkyl side chain of amorphous resin | Yes | Yes | Yes | Yes | Yes | No | No |
| Residual quantity of methylglycine diacetate in toner | 200 | 200 | 300 | 250 | 200 | — | — |

TABLE 2-continued

| | | | | | | | |
|---|---|---|---|---|---|---|---|
| quantity of aluminum in toner | 0.14 | 0.13 | 0.12 | 0.13 | 0.12 | — | 0.02 |
| quantity of ammonia in toner | 0.35 | 0.30 | 0.30 | 0.20 | 0.25 | — | 0.30 |
| Difference in gloss between thin sheet and thick sheet | AA | AA | AA | AA | AA | C | DX |
| tanδ when viscosity is 10000 Pa · s | 0.7 | 0.7 | 1.0 | 0.9 | 0.6 | 1.1 | 1.4 |
| Lowest fixing temperature | 145 | 145 | 155 | 165 | 150 | 185 | 165 |
| Temperature of HOT offset generation | 210> | 210> | 210> | 210> | 210> | 210> | 210> |

In Table 2, the toners are produced through the use of the wet production method (emulsion aggregating method), except for Comparative Example 1 employing a kneading and pulverizing method.

In Examples 8 to 13, a monomer (dodecenyl succinate or dimer diol) having an alkyl side chain is used as a source material (polymerization unit) of the amorphous polyester resin used as the binder resin. In Examples 9 to 11 and 13, the crystalline polyester resin along with the amorphous polyester resin is used as the binder resin.

The residual quantities (contents) of methylglycine diacetate in the toners are the same as shown in Table 2, in which Examples 1 and 3 employ a value around the lower limit of the range (5 to 500 ppm) of the invention, Examples 2 and 4 employ a value of the upper limit, and the other examples employ a value around the center of the range. In Comparative Examples 1 and 2, methylglycine diacetate is not added.

The residual quantities (contents) of aluminum in the toners are the same as shown in Table 2, in which Examples 1 and 2 employ the lower limit of the range (0.07% to 0.18%) of the invention, Examples 3 and 4 employ a value around the upper limit, and the other examples employ a value around the center of the range. In Comparative Example 1, aluminum is not added.

Regarding the residual quantities (the contents of ammonium ion $NH_4^+$) of ammonia in the toners, Examples 1 to 5 and 8 employ a value less than the preferable range (0.05 mg/l to 0.6 mg/l) of the invention in, Example 7 employs the upper limit of the range, and the other examples employ a value around the center of the range. In Comparative Example 1, ammonia is not added.

A fixing test is performed using the developers employing the above-mentioned toners and the difference in gloss between a thin paper and a thick paper, the lowest fixing temperature, and the HOT offset generation temperature are evaluated.

As shown in Table 2, even when one (Examples 2 and 3) or both (Example 1) of the residual quantity of methylglycine diacetate in the toner or the residual quantity of aluminum in the toner is the lower limit, the difference in gloss between an image fixed to a thin sheet of paper and an image fixed to a thick sheet of paper is evaluated as "B" (equal to or more than 2.5 degree and less than 3.5).

In Example 4, the residual quantity of methylglycine diacetate in the toner or the residual quantity of aluminum in the toner are values around the upper limit of the range. In Example 5, both are values around the center of the range. The difference in gloss is evaluated as "B" (equal to or more than 2.5 degree and less than 3.5).

In Examples 6 and 7, the residual quantity of methylglycine diacetate in the toner or the residual quantity of aluminum in the toner are values around the center of the range, the residual quantity of ammonia in the toner is in the range of from the value around the center of the range to the upper limit thereof, the used binder resin (PES-A1+PES-A2) is the same as in Examples 4 and 5, and the difference in gloss is evaluated as "A" (equal to or more than 1.5 degree and less than 2.5). The reason is considered that the residual quantity of ammonia in the toner is in the range of from the value around the center of the preferable range of the invention to the upper limit thereof and thus it is possible to suppress the influence of sodium ions. In Example 8, the residual quantity of methylglycine diacetate in the toner or the residual quantity of aluminum in the toner is around the center of the range and the residual quantity of ammonia is 0. The reason why the difference in gloss in Example 8 is evaluated as "A" (equal to or more than 1.5 degree and less than 2.5) is that the amorphous polyester resin (PES-A3+PES-A4) obtained by polymerizing the monomer (dodecenyl succinate) having an alkyl side chain is used as the binder resin and it is thus possible to suppress the influence of sodium ions.

In Examples 9, 10, 12, and 13, the amorphous polyester resin (PES-A3+PES-A4 or PES-A3+PES-A5) obtained by polymerizing the monomer (dodecenyl succinate) having an alkyl side chain is used as the binder resin and it is thus possible to suppress the influence of sodium ions. In addition, by the effect of use of the amorphous polyester resins PES-A4 (Mw=95000 and Mn=8200) and PES-A5 (Mw=140000 and Mn=10000) having a large molecular weight, the difference in gloss is evaluated as "AA" (less than 1.5 degree).

In Example 11, the amorphous polyester resin (PES-A4+PES-A6) obtained by polymerizing the monomer (dodecenyl succinate and dimer diol) having an alkyl side chain is used as the binder resin and it is thus possible to suppress the influence of sodium ions. Accordingly, the difference in gloss is evaluated as "AA" (less than 1.5 degree).

On the other hand, in Comparative Example 1, the amorphous polyester resin (PES-A5) obtained by polymerizing the monomer (dodecenyl succinate) having an alkyl side chain is used as the binder resin and the molecular weight thereof is large (Mw=140000 and Mn=10000), but the difference in gloss is evaluated as "C" (equal to or more than 3.5 degree and less than 5.0). This is because polymer components are cut during the kneading in the kneading and pulverizing method and the effect of suppressing the difference in gloss is not satisfactorily achieved. By using such a high-molecular-weight resin, the fixing temperature is markedly raised and it is thus not possible to achieve the low-temperature fixability.

In Comparative Example 2, the same binder resin (PES-A1+PES-A2) as in Examples 1 to 7 is used, but methylglycine diacetate is not used, and thus the difference in gloss is evaluated as "D" (equal to or more than 5.0 degree).

In Examples 9, 10, 11, and 13 using the crystalline resin, the lowest fixing temperature may be lowered by about 20° C., compared with the case where the crystalline resin is not used. In Example 8, the amount of ammonia is 0 and thus the difference in gloss is worse than that in Example 9.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

a binder resin;

a release agent;

a black colorant;

a methylglycine diacetate; and an aluminum element, wherein the content of the methylglycine diacetate is in the range of from 5 ppm to 500 ppm, and wherein the content of the aluminum element is in the range of from 0.07 atomic % to 0.18 atomic % in total element analysis using fluorescent X-rays.

2. The electrostatic charge image developing toner according to claim 1, wherein the electrostatic charge image developing toner contains ammonia in the range of from 0.05 mg/l to 0.6 mg/l in terms of $NH_4^+$ ions.

3. The electrostatic charge image developing toner according to claim 1, wherein the binder resin contains a polyester resin obtained by polymerizing a monomer having an alkyl side chain.

4. The electrostatic charge image developing toner according to claim 1, wherein the binder resin contains a crystalline polyester.

5. The electrostatic charge image developing toner according to claim 3, wherein the monomer with an alkyl side chain is a monomer selected from dodecenyl succinate, derivatives thereof, and dimer diol.

6. The electrostatic charge image developing toner according to claim 4, wherein a melting temperature of the crystalline polyester is in the range of from about 55° C. to about 90° C.

7. The electrostatic charge image developing toner according to claim 1, wherein the electrostatic charge image developing toner has tan δ in the range of from about 0.5 to about 1.1 when a melting viscosity is 10000 Pa.s.

8. An electrostatic charge image developer comprising:

the electrostatic charge image developing toner according to claim 1; and a carrier.

9. The electrostatic charge image developer according to claim 8, wherein the electrostatic charge image developing toner contains ammonia in the range of from 0.05 mg/l to 0.6 mg/l in terms of $NH_4^+$ ions.

10. An image forming method comprising:

charging a surface of an image holding member;

forming an electrostatic latent image on the surface of the image holding member;

developing the electrostatic latent image formed on the surface of the image holding member with a developer to form a toner image; and transferring the developed toner image to a transfer medium, wherein the developer is the electrostatic charge image developer according to claim 8.

11. The image forming method according to claim 10, wherein the electrostatic charge image developing toner includes ammonia in the range of from 0.05 mg/l to 0.6 mg/l in terms of $NH_4^+$ ions.

* * * * *